US009424705B1

(12) United States Patent
Ito et al.

(10) Patent No.: US 9,424,705 B1
(45) Date of Patent: Aug. 23, 2016

(54) MONEY HANDLING APPARATUS

(71) Applicant: GLORY LTD., Himeji-shi, Hyogo (JP)

(72) Inventors: Osamu Ito, Lisle, IL (US); Tatsuo Kugai, Himeji (JP); Antonio Carrilho, Torres Vedras (PT); Carlos Pedro, Torres Vedras (PT)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 14/748,422

(22) Filed: Jun. 24, 2015

Related U.S. Application Data

(60) Provisional application No. 62/024,007, filed on Jul. 14, 2014.

(51) Int. Cl.
*G07D 13/00* (2006.01)
*G07D 11/00* (2006.01)

(52) U.S. Cl.
CPC ..... *G07D 11/0084* (2013.01); *G07D 11/0006* (2013.01); *G07D 11/009* (2013.01); *G07D 11/0012* (2013.01); *G07D 11/0021* (2013.01); *G07D 11/0057* (2013.01); *G07D 11/0072* (2013.01); *G07D 11/0081* (2013.01)

(58) Field of Classification Search
CPC . G07D 7/00; G07D 11/0003; G07D 11/0006; G07D 11/0018; G07D 11/0021; G07D 11/0051; G07D 11/0054; G07D 11/0057; G07D 11/006; G07D 11/0072; G07D 11/0081; G07D 2211/00
USPC ..... 194/215, 350
See application file for complete search history.

(56) References Cited

U.S. PATENT DOCUMENTS

| | | | | |
|---|---|---|---|---|
| 7,731,008 | B2 * | 6/2010 | Peart | G07G 1/0027 194/350 |
| 7,766,146 | B2 * | 8/2010 | Nakatsuka | G07C 9/00142 194/206 |
| 8,905,220 | B2 * | 12/2014 | Yokote | G07D 11/0003 194/350 |
| 2009/0017740 | A1 * | 1/2009 | Oie | G07D 1/04 453/58 |

* cited by examiner

*Primary Examiner* — Mark Beauchaine
(74) *Attorney, Agent, or Firm* — Renner, Kenner, Greive, Bobak, Taylor & Weber

(57) ABSTRACT

A money handling apparatus is constituted by a mechanical processing unit configured to mechanically process money, and a manually-handled money storage unit for storing money by a manual handling. The mechanical processing unit includes an inlet for receiving money, a recognition and counting unit configured to recognize and count the money that has been received in the inlet, a mechanically-processed money storage unit configured to store the money, an outlet to which the money fed from the mechanically-processed money storage unit is discharged, and a money transport unit configured to connect these units and portions. The manually-handled money storage unit is not connected to the money transport unit of the mechanical processing unit, and has a structure in which money to be manually managed can be directly stored therein by hand and the stored money can be directly taken out therefrom by hand.

18 Claims, 16 Drawing Sheets

FIG.13A

LOGON SCREEN

LOGON

USER NAME:

PASSWORD:

7 8 9

4 5 6

1 2 3

0 CLEAR

LOGON CANCEL

FIG.13C

COUNT SCREEN

| VALUE | COUNT | TOTAL |
|---|---|---|
| $100.00 | 100 | $10,000.00 |
| $50.00 | 200 | $10,000.00 |
| $20.00 | 200 | $4,000.00 |
| $10.00 | 100 | $1,000.00 |
| $5.00 | 100 | $500.00 |
| $2.00 | 0 | $0.00 |
| $1.00 | 100 | $100.00 |
| TOTAL | | $25,600.00 |

COUNT MORE

CANCEL

FIG.13B

MAIN MENU

SELECT ACTION

COUNT CASH IN CASH OUT

ADMINISTRATION LOCK

FIG.13D

CASH IN SCREEN

| VALUE | COUNT | TOTAL |
|---|---|---|
| $100.00 | 5 | $500.00 |
| $50.00 | 5 | $250.00 |
| $20.00 | 10 | $200.00 |
| $10.00 | 5 | $50.00 |
| $5.00 | 5 | $25.00 |
| $2.00 | 0 | $0.00 |
| $1.00 | 10 | $10.00 |
| TOTAL | | $1,035.00 |

MORE CASH

FINISH

CANCEL

FIG.15A

CASH IN SCREEN

| VALUE | COUNT | TOTAL |
|---|---|---|
| $100.00 | 5 | $500.00 |
| $50.00 | 5 | $250.00 |
| $20.00 | 5 | $100.00 |
| $10.00 | 5 | $50.00 |
| $5.00 | 5 | $25.00 |
| $2.00 | 0 | $0.00 |
| $1.00 | 10 | $10.00 |
| TOTAL | | $935.00 |

MORE CASH

FINISH

CANCEL

REMOVE THE FIVE $20 BANKNOTES HAVING BEEN DISCHARGED TO THE OUTLET AND STORE THEM IN THE DRAWER NO. 3 WHOSE LED IS ON

FIG.15B

CASH OUT SCREEN 2 – MIX AND DISPENSE

CASH OUT

| | | |
|---|---|---|
| DESIRED | | $200.00 |
| $100.00 | 2 | $200.00 |
| $50.00 | 0 | $0.00 |
| $20.00 | 0 | $0.00 |
| $10.00 | 10 | $100.00 |
| $5.00 | 0 | $0.00 |
| $1.00 | 0 | $0.00 |
| SELECTED | | $300.00 |

7 8 9
4 5 6
1 2 3
0 CLEAR NEXT

REMOVE THE TEN $10 BANKNOTES FROM THE DRAWER NO. 3 WHOSE LED IS ON

FIG.15C

EMPTY SCREEN

| ID | STATUS | VALUE | COUNT | TOTAL | |
|---|---|---|---|---|---|
| RSM1 | OK | $1.00 | 25 | $25.00 | EMPTY |
| RSM2 | OK | $1.00 | 36 | $36.00 | EMPTY |
| RSM3 | OK | $5.00 | 344 | $1,720.00 | EMPTY |
| RSM4 | OK | $10.00 | 361 | $3,610.00 | EMPTY |
| RSM5 | OK | $20.00 | 332 | $6,640.00 | EMPTY |
| RSM6 | OK | $20.00 | 331 | $6,620.00 | EMPTY |
| | | | | $18,651.00 | |
| DRWR3 | | $20.00 | 20 | $400.00 | |
| | | $10.00 | 10 | $100.00 | |
| | | | | $500.00 | |
| TOTAL | $19,151.00 | | | | EMPTY ALL / DONE |

FIG.15D

INVENTORY SCREEN

| | VALUE | COUNT | TOTAL |
|---|---|---|---|
| | $100.00 | 281 | $28,100.00 |
| | $50.00 | 261 | $13,050.00 |
| | $20.00 | 663 | $13,260.00 |
| | $10.00 | 361 | $3,610.00 |
| | $5.00 | 344 | $1,720.00 |
| | $1.00 | 61 | $61.00 |
| | | 1971 | $59,801.00 |
| DRWR3 | $20.00 | 20 | $400.00 |
| | $10.00 | 10 | $100.00 |
| | | | $500.00 |
| TOTAL | $60,301.00 | | |

DONE

MONEY HANDLING APPARATUS

RELATED APPLICATION

The present application claims priority to the U.S. provisional patent application Ser. No. 62/024,007, filed on Jul. 14, 2014, which is incorporated herein entirely by reference.

BACKGROUND OF THE INVENTION

1. Field of the Invention

The present invention relates to a money handling apparatus capable of storing money processed by machine and money processed by hand.

2. Description of the Related Art

Conventionally, money handling apparatuses have been used in financial institutions such as banks. For example, in a depositing process for depositing money to a bank account and the like, a money handling apparatus is used to perform processes of recognizing the denomination, authenticity, fitness, and the like of money to be deposited and counting the deposited money. In this process, abnormal money, such as a counterfeit banknote, is discharged to an outside of the apparatus, while normal money is counted on the basis of the denomination and stored in a money storage unit provided inside the apparatus. In a dispensing process for dispensing money from a bank account and a check caching process for encashing checks, money is dispensed by a money handling apparatus from a money storage unit.

For example, in banks, in a state in which the teller faces the customer across the teller counter, the teller performs banking services such as depositing, dispensing, check cashing, and the like according to requests from the customer. In many cases, a drawer is installed in the teller counter that opens on the side of the teller, and the teller uses this drawer to store some money, checks, documents necessary for the banking services, and the like.

It is desired that the teller counter, the drawer, and the money handling apparatus be installed in such a manner that the teller can easily perform banking services. In addition, it is desirable that the money to be handled by the teller be strictly mechanically managed by using the money handling apparatus rather than being manually managed by being stored in the drawer and the like.

SUMMARY OF THE INVENTION

One object of the present invention is to provide a money handling apparatus capable of realizing an environment that allows the tellers to easily perform banking services. Another object of the present invention is to provide a money handling apparatus capable of assisting the tellers in performing their banking services and to strictly manage money handled by the tellers.

According to an aspect of the invention, the money handling apparatus includes a mechanical processing unit configured to mechanically process money; and a manually-handled money storage unit configured to manually store money. The mechanical processing unit includes an inlet for receiving money; a recognition and counting unit configured to recognize and count the money received in the inlet; a mechanically-processed money storage unit configured to store the money; an outlet for discharging the money fed from the mechanically-processed money storage unit; and a money transport unit configured to connect the inlet, the outlet, the recognition and counting unit, and the mechanically-processed money storage unit. The manually-handled money storage unit is not connected to the money transport unit, and has a structure that enables to directly store money to be manually managed therein by hand and directly take out the money therefrom by hand. With this configuration, it is enabled to handle some money, which cannot be processed by the mechanical processing unit, by using the manually-handled money storage unit in a manner similar to that in conventional operations that use drawers while processing and strictly managing money by using the mechanical processing unit.

The manually-handled money storage unit further includes a storage amount detection unit configured to detect a storage amount of the money stored in the manually-handled money storage unit, wherein a control unit of the mechanical processing unit is configured to manage the storage amount of the money stored in the mechanically-processed money storage unit on the basis of results of recognition and counting by the recognition and counting unit and manage the storage amount of the money stored in the manually-handled money storage unit on the basis of detection results by the storage amount detection unit. With this configuration, it is also enabled to mechanically manage money to be stored in the manually-handled money storage unit.

BRIEF DESCRIPTION OF THE DRAWINGS

FIGS. 6A, 6B, and 60 are views that illustrate examples of storage of loose coins in the drawer.

FIGS. 9A, 9B, and 90 are views that illustrate other examples of storage of wrapped coin rolls in the drawer.

FIGS. 10A, 10B, and 100 are views that illustrate yet other examples of storage of wrapped coin rolls in the drawer.

FIGS. 13A, 13B, 13C, 13D, 13E, 13F, and 13G illustrate examples of a screen for describing a main menu of the money handling apparatus.

FIGS. 14A, 14B, 14C, and 140 illustrate examples of a screen for describing a management menu of the money handling apparatus.

FIGS. 15A, 15B, 15C, and 15D illustrate examples of a screen for describing an example of a method of managing money stored in the manually-handled money storage unit.

DETAILED DESCRIPTION

According to the money handling apparatus of the present invention, recognition, counting, storage, and dispensing (withdrawal) of money can be mechanically performed, and storage and dispensing (removal) of money can be manually performed. At least either one of banknotes and coins can be set as an object of mechanical processes and at least either one of banknotes and coins can be set as an object of manual handling. Moreover, objects other than money, such as checks, can be set as the object to be stored in the manual handling. In the following description, an example in which the object of the mechanical process is banknotes only and both banknotes and coins are the objects of the manual handling process is explained.

The mechanical process is a process performed while mechanically transporting banknotes by using a banknote transport unit. The mechanical process includes processes for recognizing, counting, and storing banknotes performed inside the apparatus, a process for dispensing banknotes from the inside of the apparatus, and the like. In contrast, the manual handling process is a process by carrying banknotes by hand, but not by a banknote transport unit. The manual handling process includes a process for storing banknotes and coins directly into the apparatus by hand and a process for taking out banknotes and coins directly from inside the apparatus by hand.

Figure 1:
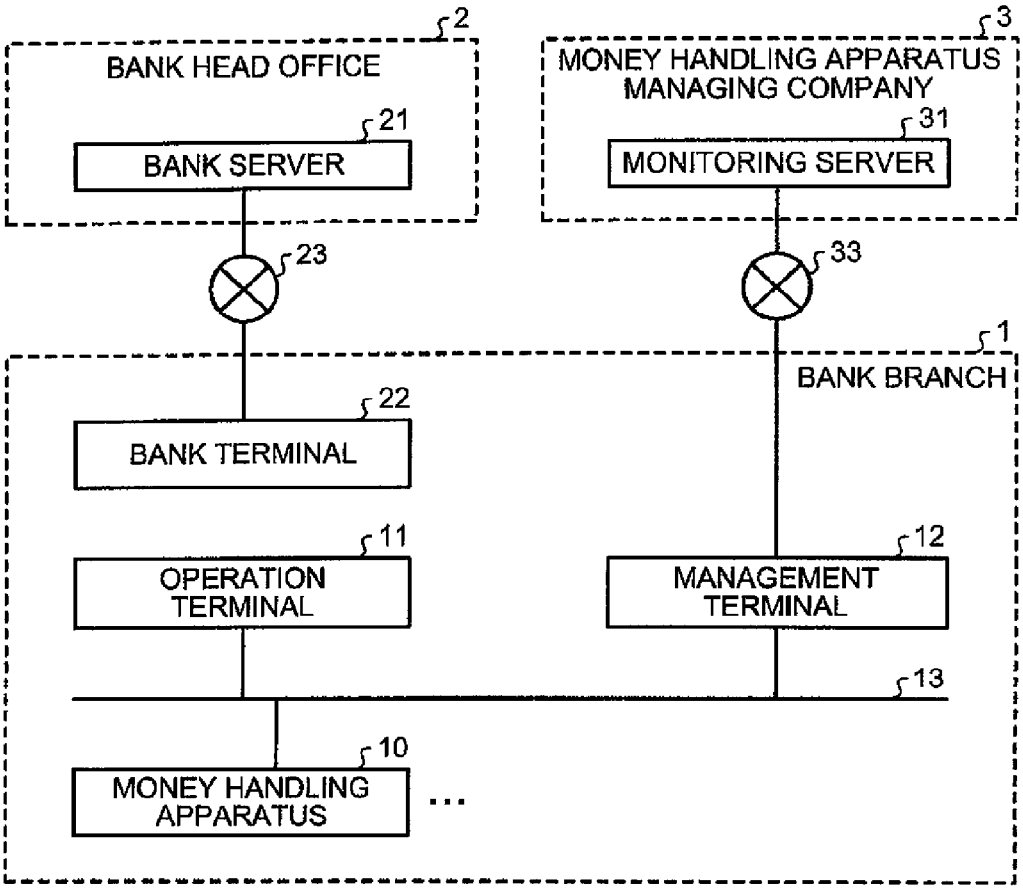
FIG. 1 is a view that illustrates an example of a configuration of a system in which a money handling apparatus according to an embodiment of the present invention is used.

FIG. 1 illustrates an example of a configuration of a system that uses a money handling apparatus 10 according to the present embodiment. The money handling apparatus 10 is installed in a bank branch 1 and is connected to a network 13, such as a local area network (LAN). An operation terminal 11 and a management terminal 12 are also connected to the network 13. The operation terminal 11 is a terminal constituted by a computer apparatus for operating the money handling apparatus 10. For example, a tablet type terminal that is connected to the network 13 by wireless or wired communication is used as the operation terminal 11. Mechanical processes by the money handling apparatus 10 can be performed by operating the operation terminal 11. The management terminal 12 is a terminal constituted by a computer apparatus for monitoring statuses of the money handling apparatus 10. The management terminal 12 manages money stored in the money handling apparatus 10 and manages the statuses of the apparatus by detecting errors and failures that have occurred inside the apparatus.

A bank terminal 22, which is not connected to the network 13, is installed in the bank branch 1. The bank terminal 22 is connected via a network 23, such as the Internet, to a bank server 21 that is installed in a bank head office 2. The bank server 21 manages bank accounts of customers and banking services performed by branches of the bank. For example, when a customer has requested the teller of the bank branch 1 a depositing process to deposit money into the bank account of the customer, the teller inputs information, such as the bank account number of the customer and the amount of the money to be deposited by the customer, to the bank terminal 22. The inputted information is transmitted from bank terminal 22 to the bank server 21, the information about the bank account of the customer is updated in accordance with the inputted information, and thus the depositing process is completed. In performing the depositing process, banknotes and the coins that the teller has received from the customer are stored in the money handling apparatus 10 in the bank branch 1, and this storage process will be described in detail below.

The management terminal 12, which monitors the status of the money handling apparatus 10, is connected via a network 33, such as the Internet, to a monitoring server 31 installed in a money handling apparatus managing company 3. If any failure has occurred in the money handling apparatus 10, the management terminal 12 detects the failure, and information about the failure is transmitted from the management terminal 12 to the monitoring server 31. The money handling apparatus managing company 3 verifies the information received by the monitoring server 31 and takes measures necessary to return the money handling apparatus 10 to its normal status. For example, depending on the type of the failure that has occurred, the money handling apparatus managing company 3 operates the money handling apparatus 10 by remote control via the management terminal 12 or instructs a person in charge in the bank branch 1 to start recovery operations, or a maintenance worker of the money handling apparatus managing company 3 visits the bank branch 1 to restore the money handling apparatus 10 to the normal state.

Although only one money handling apparatus 10 is illustrated in FIG. 1, a plurality of money handling apparatuses 10 may be used in the bank branch 1. For example, one money handling apparatus 10 may be assigned to a plurality of tellers in some cases, and in other cases, one money handling apparatus 10 may be assigned per teller. If a plurality of money handling apparatuses 10 is used, one operation terminal 11 may be assigned to the plurality of money handling apparatuses 10 in some cases, and in other cases, one operation terminal 11 may be assigned per money handling apparatus 10. The form of the networks 13, 23, and 33 is not limited to any one of LAN, wide area network (WAN), the Internet, intranet, wireless communication, and wired communication, and any form of communication capable of implementing sending and receiving of necessary information can be used as the network 13, 23, and 33.

Figure 2A:
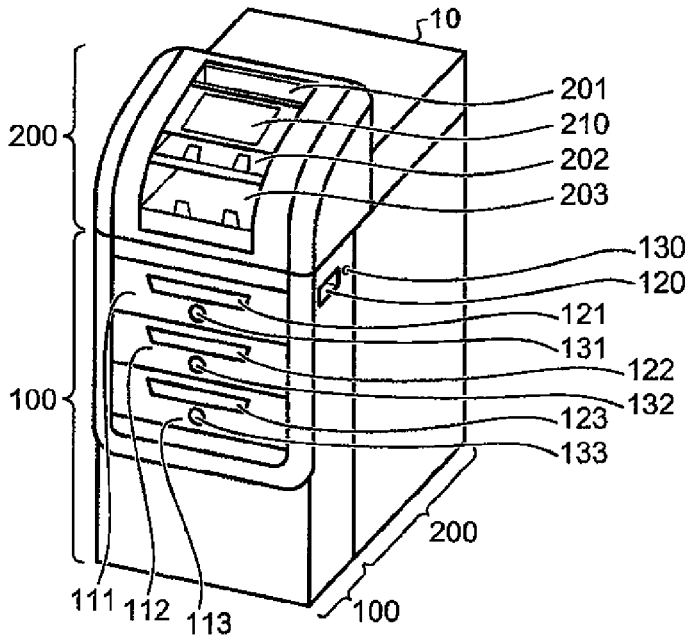
FIGS. 2A and 2B are views that illustrate an example of an appearance and installation of the money handling apparatus.
Figure 2B:
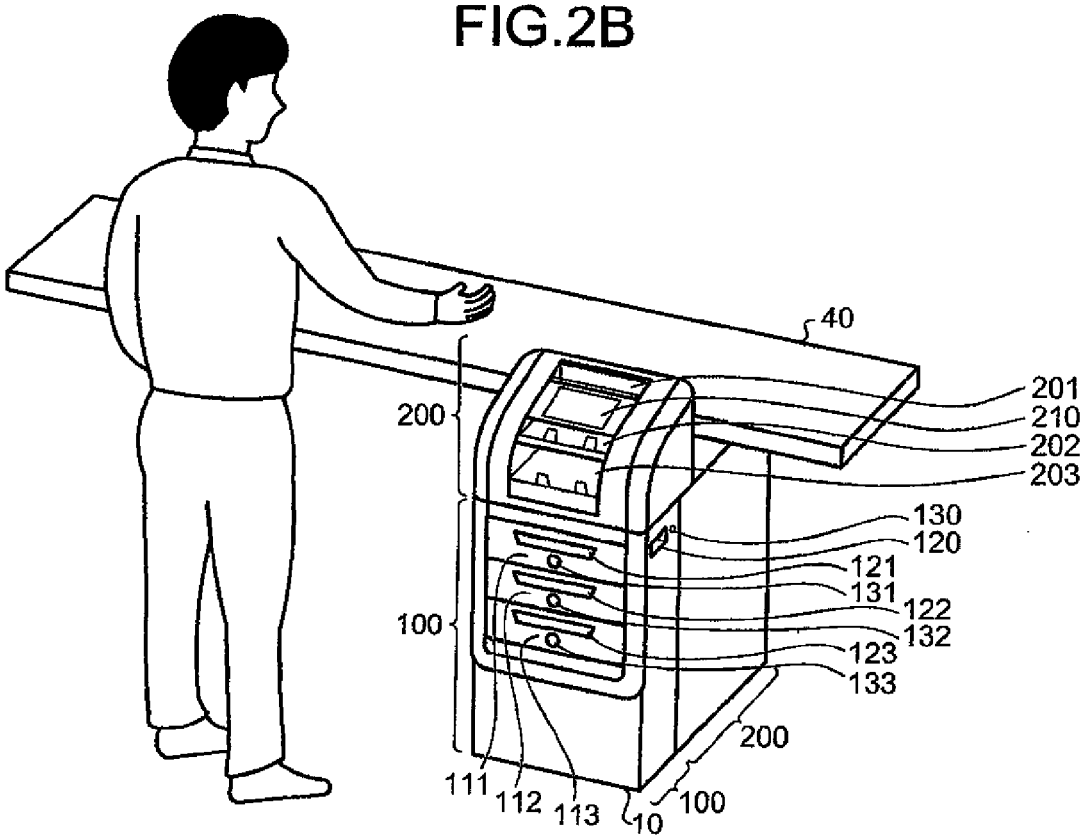

FIG. 2A is a perspective view which illustrates an external appearance of the money handling apparatus 10, and FIG. 2B is a perspective view which illustrates an example of installation of the money handling apparatus 10. The money handling apparatus 10 is constituted by a manually-handled money storage unit 100 and a mechanical processing unit 200. The manually-handled money storage unit 100 is arranged on a front side of the money handling apparatus 10, and the mechanical processing unit 200 is arranged on an upper side and a back side of the manually-handled money storage unit 100.

The mechanical processing unit 200, provided in the upper portion on the front side of the money handling apparatus 10, includes an inlet 201, a reject unit 202, and an outlet 203 in this order from the upper portion of the apparatus. The inlet 201 receives banknotes to be subjected to a counting process and a depositing process. Rejected banknotes, which are banknotes that cannot be stored into the mechanical processing unit 200 among the banknotes received at the inlet 201, such as counterfeit banknotes, are discharged to the reject unit 202. Banknotes to be dispensed in a dispensing process are discharged into the outlet 203.

The counting process, the depositing process, and the dispensing process are a mechanical process performed by the mechanical processing unit 200. The counting process is a process in which the banknotes that have been received in the inlet 201 are discharged to the outlet 203 after performing only recognition and counting, without storing them in the mechanically-processed banknote storage unit provided in the mechanical processing unit 200. In the counting process, the banknotes received at the inlet 201 are fed into the apparatus sheet by sheet, the denomination and the authenticity of the respective banknotes are recognized, and then rejected banknote are discharged to the reject unit 202 and the other normal banknotes are discharged to the outlet 203. The depositing process is a process for storing the banknotes that have been received at the inlet 201 into the mechanically-processed banknote storage unit provided in the mechanical processing unit 200. In the depositing process, the banknotes that have been received at the inlet 201 are fed into the apparatus one by one, the denomination, the authenticity, and the fitness of the respective banknotes are recognized, and then rejected banknote are discharged to the reject unit 202 and normal banknotes are stored in a corresponding mechanically-processed banknote storage unit on the basis of results of the recognition. The dispensing process is a process in which the banknotes that have been stored in the mechanically-processed banknote storage unit provided in the mechanical processing unit 200 are discharged from the outlet 203 on the basis of the amount and the denomination designated by operating the operation terminal 11. The processes for banknotes, such as the counting process, depositing process, and dispensing process performed by the money handling apparatus 10, are similar to those of prior art, and therefore detailed descriptions thereof are omitted herein. Although the money handling apparatus 10 can also perform a process for depositing an amount shown on a check to a bank account and a process for dispensing money equivalent to an amount shown on a check, the depositing process and the dispensing process of money will be described as an example because the above-described processes of checks can be performed in a manner similar to those in the depositing process and the dispensing process of money.

Between the inlet 201 and the reject unit 202, a display unit 210 is arranged, which is constituted by a liquid crystal display and configured to display information about the money handling apparatus 10. However, the display unit 210 could be omitted and all pieces of information could be displayed on the operation terminal 11.

Three drawers 111 to 113 are provided in the manually-handled money storage unit 100, which is arranged on the front side of the money handling apparatus 10 and below the outlet 203. The drawers 111 to 113 are provided with handles 121 to 123 and locking mechanisms 131 to 133 that lock the drawers so that they may not be opened, respectively. In the upper portion of the right side surface of the manually-handled money storage unit 100, a handle 120 and a locking mechanism 130 for locking the manually-handled money storage unit 100 are provided.

As shown in FIG. 2B, the money handling apparatus 10 is used in a state in which it is installed under a counter table 40 of the teller counter at which the teller serves customers. The height of the money handling apparatus 10 on its front side on which the inlet 201 is provided is approximately 1,000 mm. The height of the money handling apparatus 10 in its portions located behind the inlet 201 and hidden under the counter table 40 when the money handling apparatus 10 is installed to the teller counter is approximately 870 mm, which is lower than the height of the inlet 201. The customer facing the teller can watch the teller sets the banknotes received from the customer in the inlet 201 over the counter table 40. The width of the money handling apparatus 10 is approximately 470 mm.

In the money handling apparatus 10, the inlet 201 is arranged above and in front of the counter table 40 when viewed from the teller, and the display unit 210, the reject unit 202, and the outlet 203 are arranged subsequently to and below the inlet 201. Accordingly, the teller can easily carry out an operation for putting the banknotes received from the customer in the inlet 201, an operation for visually verifying the information displayed on the display unit 210, an operation for taking out the rejected banknotes returned to the reject unit 202, an operation for taking out the banknotes discharged in the outlet 203, and the like, while servicing the customer at the teller counter with a standing posture maintained.

Figure 3A:
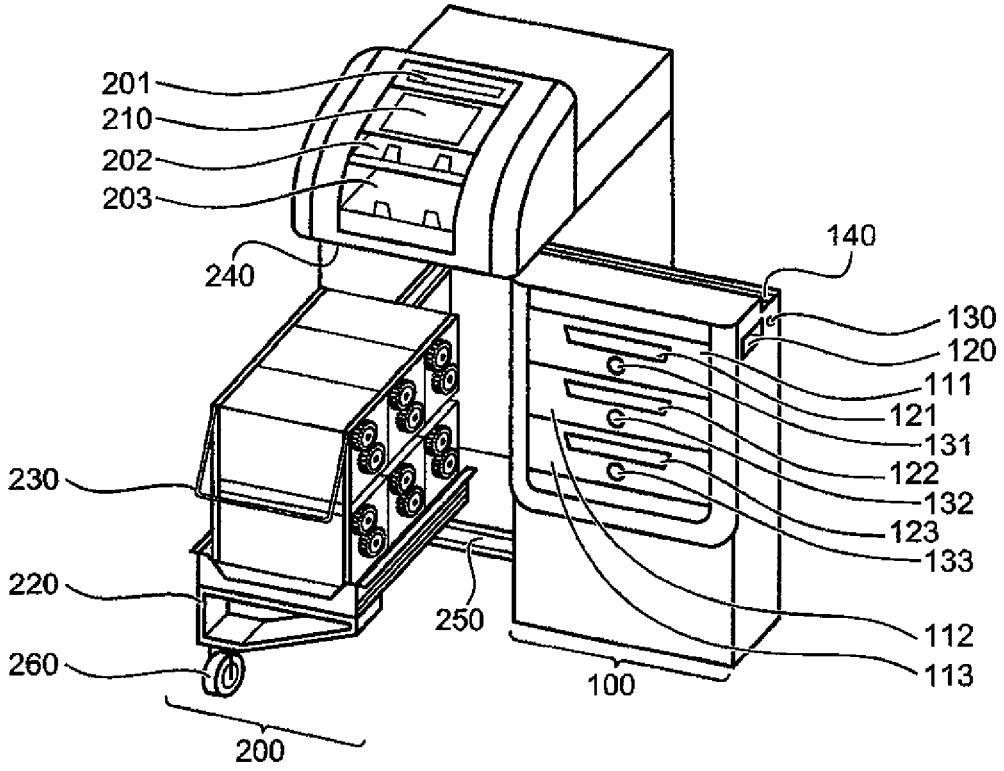
FIGS. 3A and 3B are views that illustrate a state in which a manually-handled money storage unit of the money handling apparatus has been slid when viewed from a front side of the apparatus and from a back side of the apparatus.
Figure 3B:
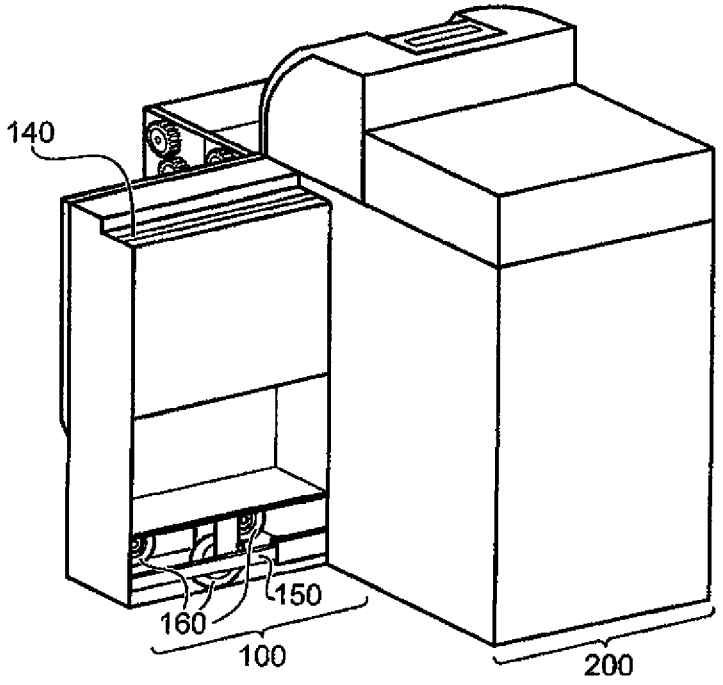

The manually-handled money storage unit 100 can be slid and moved laterally below the outlet 203. FIG. 3A is a perspective view illustrating a state in which the manually-handled money storage unit 100 has been laterally slid and moved to open an opening provided on the front side of the mechanical processing unit 200 and the mechanically-processed banknote storage unit has been drawn out from inside the mechanical processing unit 200. As shown in FIG. 3A, the mechanically-processed banknote storage unit is provided in the rear side of the manually-handled money storage unit 100. In other words, the manually-handled money storage unit 100 is provided in the front side of the mechanically-processed banknote storage unit in the mechanical processing unit 200. FIG. 3B is a perspective view illustrating a state in which the manually-handled money storage unit 100 has been laterally slid when viewed from the back side.

The manually-handled money storage unit 100 is usually locked by a locking mechanism 130 in the state illustrated in FIG. 2A so that it would not be laterally slid. For example, if jamming of banknotes or the like has occurred in the mechanically-processed banknote storage unit provided in the mechanical processing unit 200, the jammed banknotes can be taken out by releasing the locking mechanism 130 and laterally sliding the manually-handled money storage unit 100.

A rail 140 provided on the top surface of the manually-handled money storage unit 100 and a rail 240 of the mechanical processing unit 200 constitute an upper slide rail. A rail 150 provided in a lower portion of the back side of the manually-handled money storage unit 100 and a rail 250 of the mechanical processing unit 200 constitute a lower side rail. The upper slide rail is provided on the top surface of the manually-handled money storage unit 100 and the lower slide rail is provided on the back side of the manually-handled money storage unit 100, and thereby the manually-handled money storage unit 100 is enabled to slide in the left-right direction in relation to the mechanical processing unit 200 and moving of the manually-handled money storage unit 100 in a direction other than the lateral direction is restricted.

The slide rails, which are provided on the side surfaces of the drawer and used in supporting the drawer when the drawer is opened and closed, have been produced so as to have a high strength and a high positional accuracy in a direction perpendicular to the direction of sliding on the side surface on which the rails are installed, so that the drawer would not be tilted or damaged even if the weight of the stored objects in the drawer has increased. In the manually-handled money storage unit 100, the upper slide rail and the lower slide rail are installed so that the direction of high strength and a high positional accuracy may be different for respective rails. Specifically, the upper slide rail and the lower slide rail are installed so that a rail surface of the upper slide rail and a rail surface of the lower slide rail form an angle of 90 degrees.

With the upper slide rail installed on the top surface of the manually-handled money storage unit 100, the high strength and the high positional accuracy are realized in the longitudinal direction of the upper portion of the manually-handled money storage unit 100. With this configuration, the top surface of the manually-handled money storage unit 100 would not be misaligned in the front-rear direction, and thus the front surface of the mechanical processing unit 200 below the outlet 203 and the front surface of the manually-handled money storage unit 100 form the same plane. In addition, with the lower slide rail installed on the back side of the manually-handled money storage unit 100 in its lower portion, the high strength and the high positional accuracy are realized in a vertical direction of the manually-handled money storage unit 100 in its lower portion. With this configuration, the manually-handled money storage unit 100 would not be misaligned in the vertical direction and would not be inclined in the left-right direction when viewed from the front side. The number of the rails is not particularly limited, and for either one or both of the upper slide rail and the lower slide rail, a plurality of rails may be provided.

Referring to FIG. 3B, the manually-handled money storage unit 100 is provided with a plurality of wheels 160, which supports a housing so that the manually-handled money storage unit 100 can be easily slid in the left-right (lateral) direction even if a large amount of coins and the like have been stored in the drawers 111 to 113 of the manually-handled money storage unit 100 and thus the weight of the stored objects has increased.

Referring to FIG. 3A, a frame 220, which supports the mechanically-processed banknote storage unit inside the mechanical processing unit 200, is also provided with a wheel 260 so that the frame 220 can be easily slid in the front-rear direction. When the manually-handled money storage unit 100 is slid in the lateral direction, the front side of the frame 220 is exposed through the opening of the mechanical processing unit 200 on the front side thereof. By pulling a handle 230 attached to the frame 220 frontward in this state, the mechanically-processed banknote storage unit can be drawn frontward together with the frame 220. By drawing the mechanically-processed banknote storage unit to the outside of the apparatus, the banknotes that have been jammed or the like can be removed.

An example is illustrated in FIG. 3A in which the manually-handled money storage unit 100 is slid to the right when viewed from the front; however, the manually-handled money storage unit 100 can also be slid to the left. Similarly to the right side surface of the manually-handled money storage unit 100, a locking mechanism and a handle are also provided on the left side surface thereof. In using the manually-handled money storage unit 100, which of the left direction and the right direction the manually-handled money storage unit 100 is to be slid is selected in accordance with the installation environment of the money handling apparatus 10. A stopper is provided on both the right and the left ends of the upper slide rail and the lower slide rail. If the manually-handled money storage unit 100 is slid to the right, the manually-handled money storage unit 100 stops at the right end at which it has become possible to draw the frame 220 from the mechanical processing unit 200. In contrast, if the manually-handled money storage unit 100 is slid to the left, the manually-handled money storage unit 100 stops at the left end at which it has become possible to draw the frame 220 from the mechanical processing unit 200.

Figure 4:
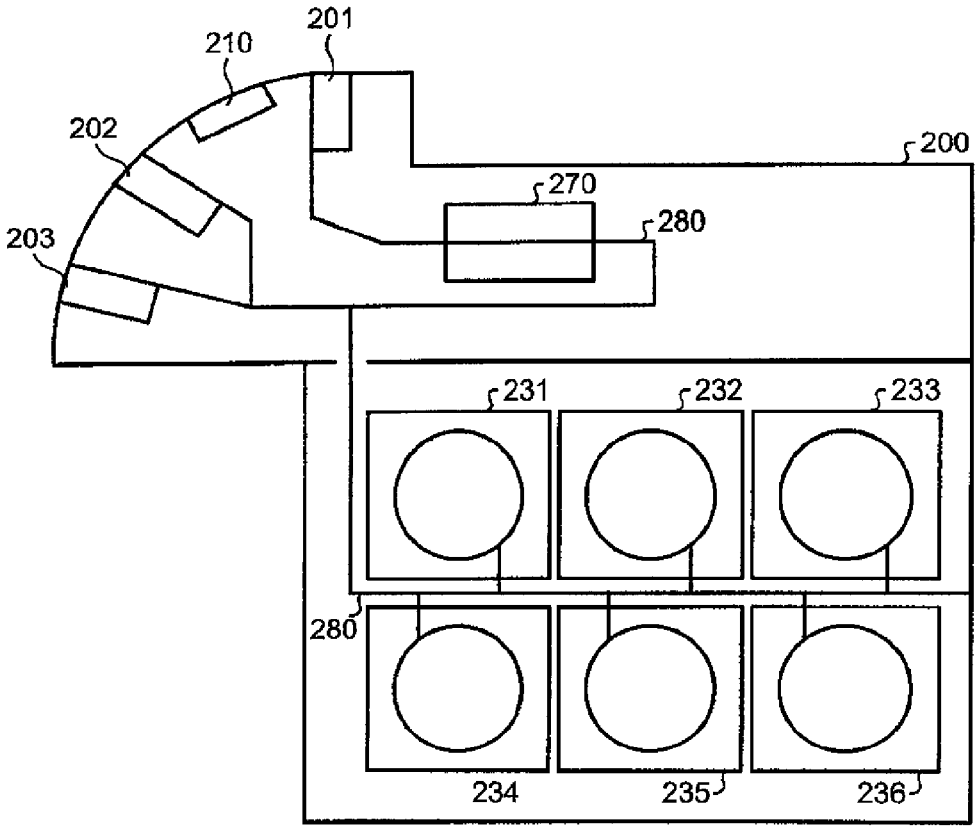
FIG. 4 is a view that illustrates an outline inner configuration of a mechanical processing unit of the money handling apparatus.

FIG. 4 is a cross-sectional schematic diagram that illustrates an outline inner configuration of the mechanical processing unit 200 of the money handling apparatus 10. On the side of the upper portion of the mechanical processing unit 200, the inlet 201, the display unit 210, the reject unit 202, the outlet 203, and a banknote recognition unit 270 are provided, which are in connection with one another via a banknote transport unit 280. On the side of the lower portion of the mechanical processing unit 200, six mechanically-processed banknote storage units 231 to 236 for storing the banknotes on the basis of attributes of the banknotes such as the denomination or the fitness are provided, which are in connection with one another via the banknote transport unit 280. The mechanically-processed banknote storage units 231 to 236 are tape type banknote storage units. These storage units are configured to store the banknotes that have been received from the banknote transport unit 280 by reeling two sheets of tape around a drum with the banknotes being respectively sandwiched between the two sheets of tape. The stored banknotes can be fed to the banknote transport unit 280 in order opposite to the stored order in the storage process.

The upper portion and the lower portion are partitioned from each other by a partition having an opening. The upper portion and the lower portion are connected to each other by the banknote transport unit 280 in the opening of the partition so that the banknotes in the inlet 201 can be stored in the mechanically-processed banknote storage units 231 to 236 and that the banknotes are discharged from the mechanically-processed banknote storage unit 231 to the outlet 203.

In the money handling apparatus 10, the lower portion of the mechanical processing unit 200 can be used as a safe. For example, only the lower portion, in which the mechanically-processed banknote storage units 231 to 236 are installed, is constituted by a steel housing, and a lockable door is provided to the front opening, which appear when the manually-handled money storage unit 100 is slid, of the mechanical processing unit 200 to realize the safe. With this configuration, the security of the mechanically-processed banknote storage units 231 to 236 that store a large quantity of banknotes can be secured. The detailed description of the configuration of the mechanical processing unit 200 and the mechanical processes carried out by the mechanical processing unit 200 is omitted herein because prior art can be used therefor.

Figure 5:
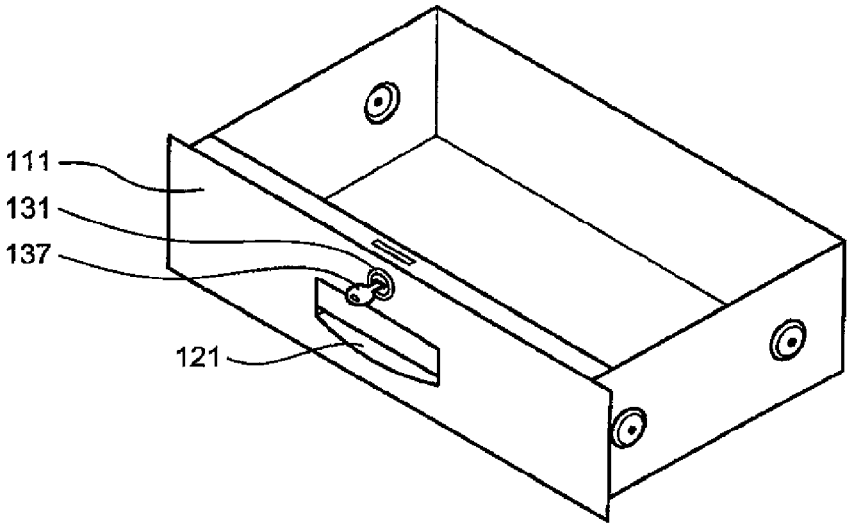
FIG. 5 is a view that illustrates a drawer used in the manually-handled money storage unit.

FIG. 5 is a perspective view that illustrates a structure of the drawer 111 of the manually-handled money storage unit 100. A space inside the drawer 111 has a dimension in the lateral direction (width) of approximately 330 mm, a dimension in the front-rear direction (depth) of approximately 200 mm, and a dimension in the vertical direction (height) of approximately 90 mm, and banknotes, coins, checks, documents, and the like can be stored in this space. A slide rail is installed between each of the left side and the right side surfaces of the drawer 111 and each of corresponding inner side surfaces of the housing of the manually-handled money storage unit 100, and thereby the drawer 111 can be easily drawn out frontward from the manually-handled money storage unit 100. The other drawers 112, 113 have the same structure as that of the drawer 111, and thus the drawers 111 to 113 can be mutually replaced with one another in using them.

The three drawers 111 to 113 provided to the manually-handled money storage unit 100 have the same structure, and by installing a tray suitable for the object to be stored therein, various types of objects to be stored can be appropriately stored. In addition, by using a tray suitable for the storage method, it is enabled to store the same type objects by different storage methods. The trays have different configurations for different objects to be stored and for different storage methods.

FIGS. 6A-6C, 7A-7C, 8A-8C, 9A-9C and 10A-10C illustrate examples of storage inside the drawers 111 to 113. FIGS. 6A, 7A, 8A, 9A, and 10A are perspective views illustrating open states of the drawers 111 to 113. FIGS. 6B, 7B, 8B, 9B, and 10B are plan views illustrating open states of the drawers 111 to 113, viewed from above. FIGS. 6C, 7C, 8C, 9C, and 10C are cross-sectional schematic diagrams illustrating the drawers 111 to 113 viewed from the front side. The locking mechanisms 131 to 133 of the drawers 111 to 113 and the locking mechanism 130 for locking the manually-handled money storage unit 100 to prevent the unit from sliding can be locked and released by using the same key 137. However, a key other than the key 137 can be used to open and close some of the drawers 111 to 113 and the manually-handled money storage unit 100.

Figure 6A:
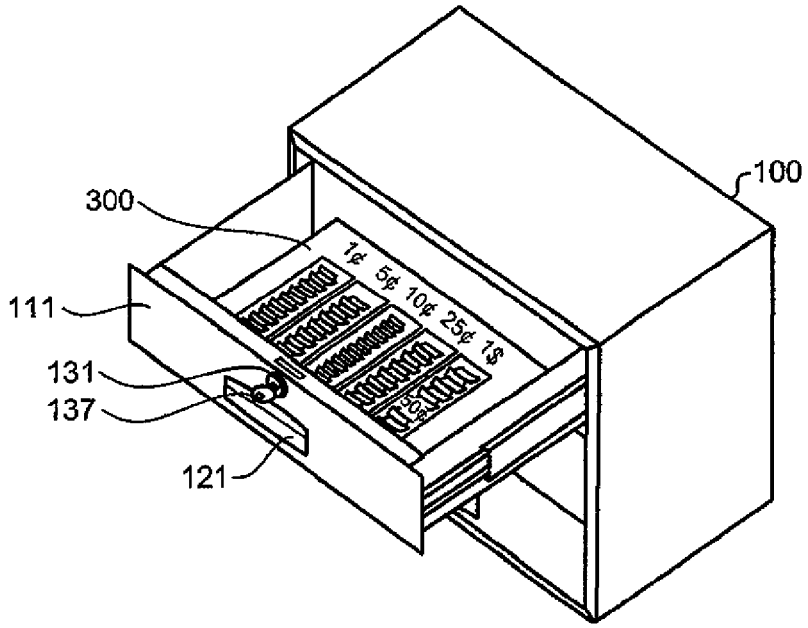
Figure 6B:
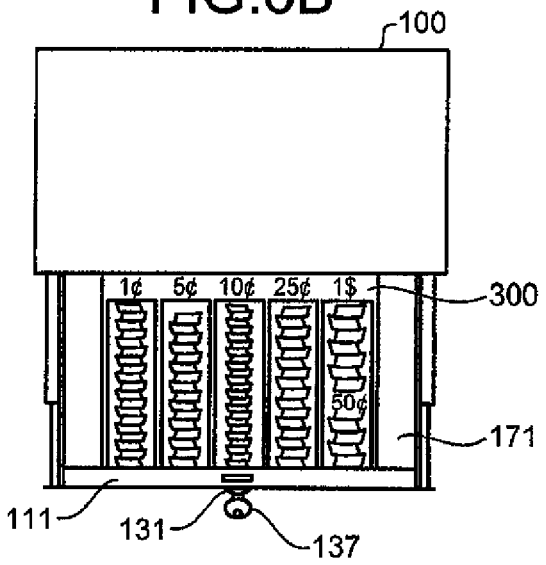
Figure 6C:
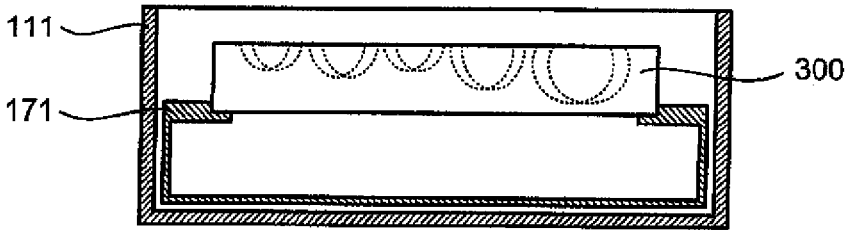

FIGS. 6A-6C illustrate examples in which loose coins are stored in the drawer 111. A coin counter 300 for storing loose coins by denomination is installed inside the drawer 111 and used. In the coin counter 300, grooves partitioned for a predetermined number of coins are arranged, each corresponding to a denomination, and thereby the number of coins of each denomination can be easily verified. Because the height of the coin counter 300 is low, if the coin counter 300 is installed onto the bottom surface of the drawer 111 alone, the coins cannot be easily taken out. Accordingly, a support tray 171 for supporting the coin counter 300 is installed on the bottom surface inside the drawer 111. By raising the installation height of the coin counter 300 inside the drawer 111 by using this support tray 171, it becomes easy to take out the coins from inside the drawer 111. The support tray 171 is configured to support the bottom surface of the coin counter 300 from both the left and the right sides to fix a position of the coin counter 300. The support tray 171 itself can also be used as a storage unit. Specifically, another coin counter 300 can be placed in a space below the coin counter 300, and alternatively, wrapped coin rolls, banknotes, and the like can be accommodated in this space.

Figure 7A:
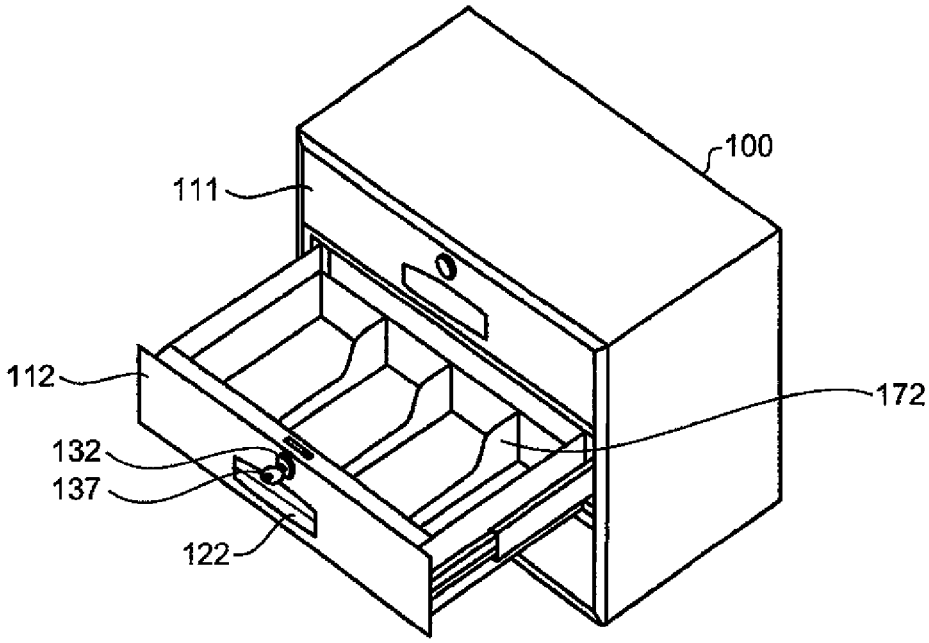
FIGS. 7A, 7B, and 7C are views that illustrate examples of storage of banknotes in the drawer.
Figure 7B:
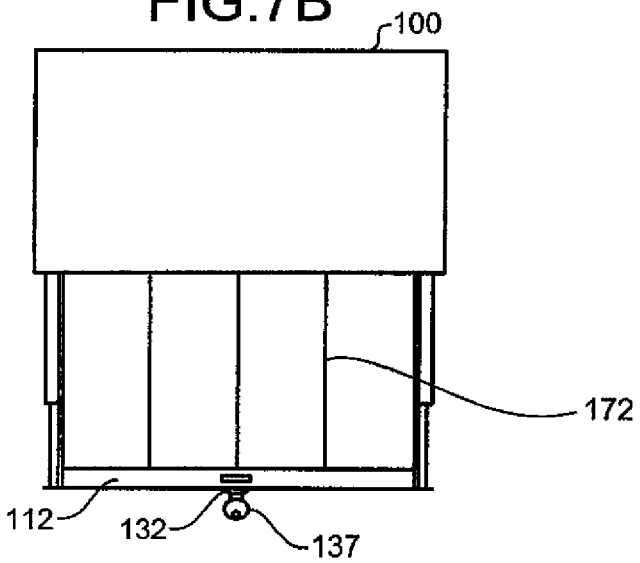
Figure 7C:
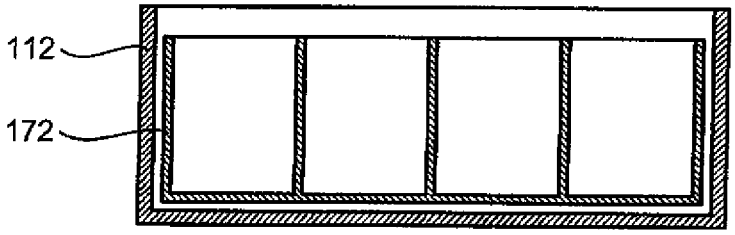

FIGS. 7A-7C illustrate examples in which banknotes are stored in the drawer 112. A banknote storage tray 172 is installed inside the drawer 112. The banknote storage tray 172 has a box-like shape and its entire top plane is opened. The space inside the box is partitioned into four storage spaces of the same size by using three partition plates. The respective storage spaces can accommodate loose banknotes or bundled banknotes. 460 sheets of banknotes can be accommodated in the respective storage space if the banknotes to be stored are flat banknotes that do not have surface irregularities formed by wrinkles or the like.

Figure 8A:
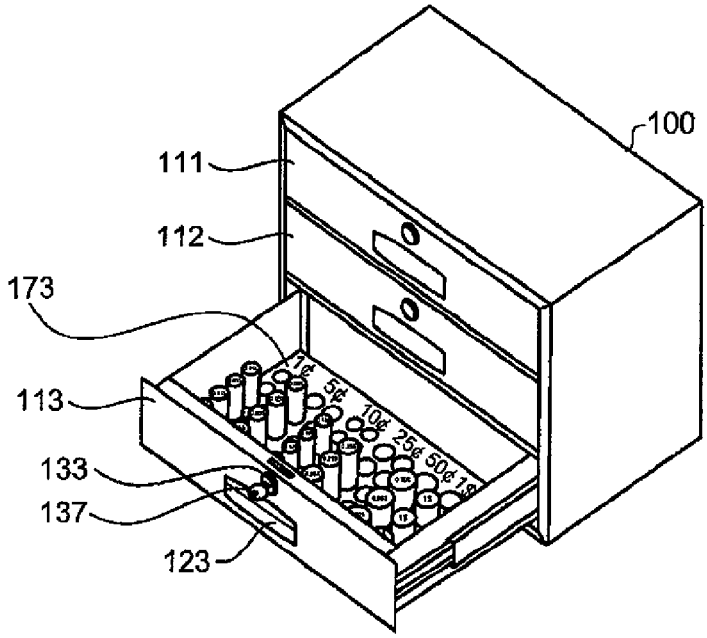
FIGS. 8A, 8B, and 8C are views that illustrate examples of storage of wrapped coin rolls in the drawer.
Figure 8B:
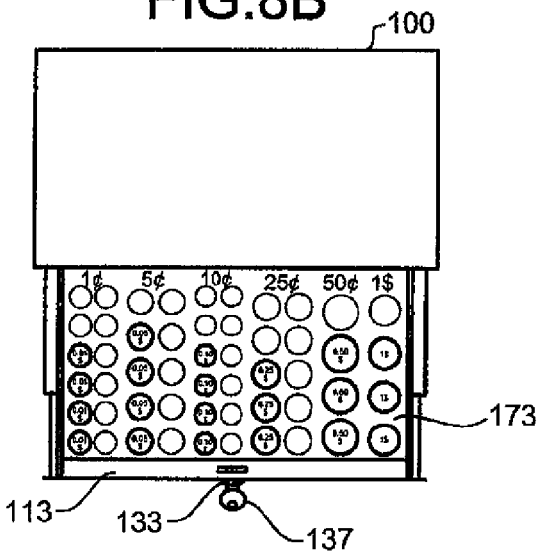
Figure 8C:
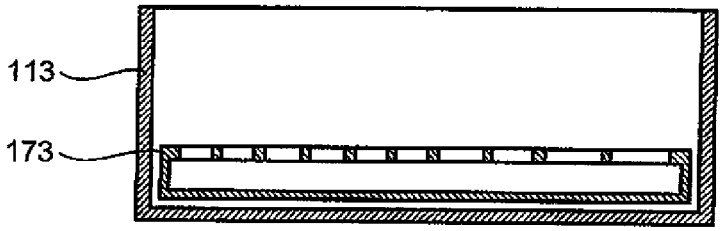

FIGS. 8A-8C illustrate examples in which wrapped coin rolls are stored in the drawer 113. A wrapped coin storage tray 173 is installed inside the drawer 113. The wrapped coin storage tray 173 has a configuration in which a plurality of circular openings is provided on the upper surface of the box-shaped portion constituted by a thin plate. The size of the opening is designed in accordance with the diameter of the coins so that it is large enough to insert one wrapped coin roll of the coins, and a plurality of openings is provided for wrapped coin rolls of different denominations. In the drawer 113, each wrapped coin roll is inserted into the opening corresponding to the denomination whereby the wrapped coin roll stands upright in a stacking direction of coins in the wrapped coin roll. In the wrapped coin storage tray 173, twelve wrapped coin rolls of 1-cent coins, ten wrapped coin rolls of 5-cent coins, twelve wrapped coin rolls of 10-cent coins, ten wrapped coin rolls of 25-cent coins, four wrapped coin rolls of 50-cent coins, and four wrapped coin rolls of 1-dollar coins can be accommodated.

Figure 9A:
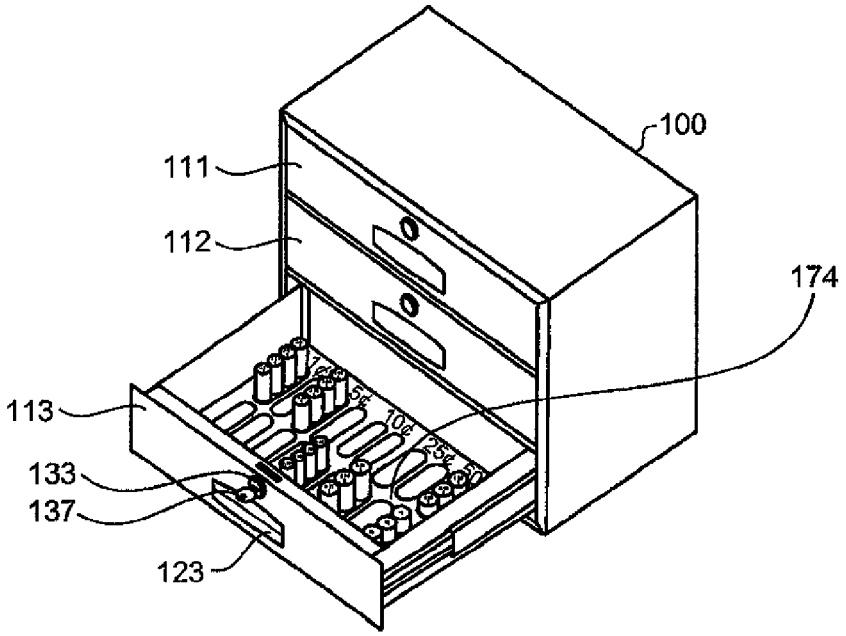
Figure 9B:
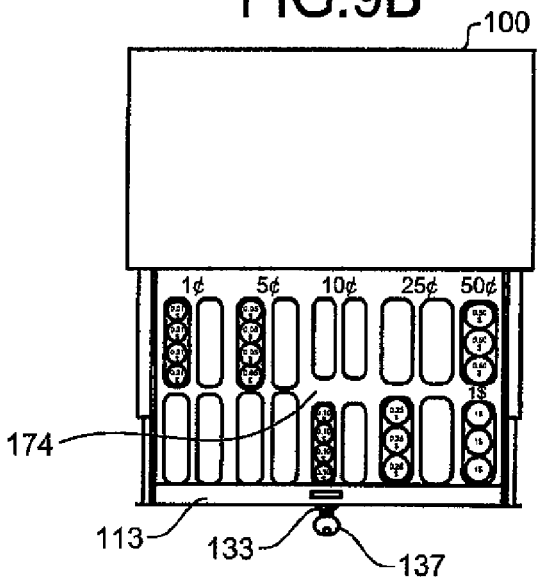
Figure 9C:
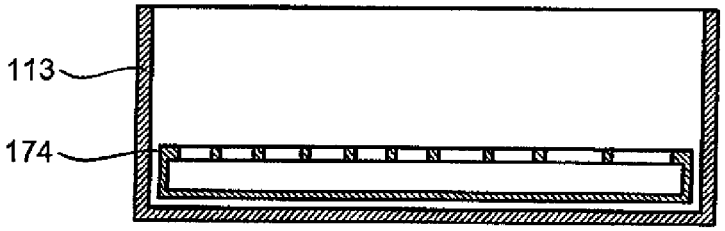
Figure 10A:
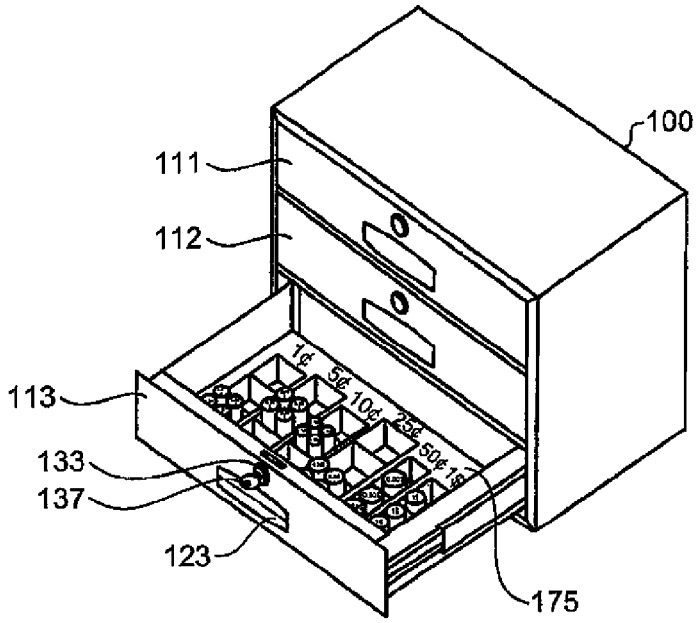
Figure 10B:
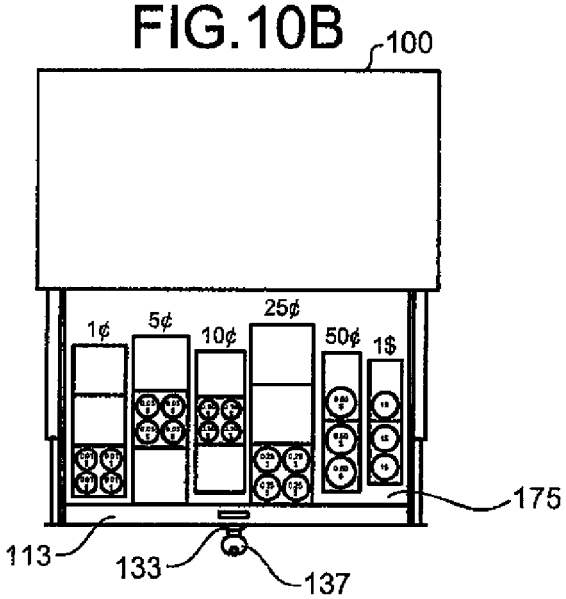
Figure 10C:
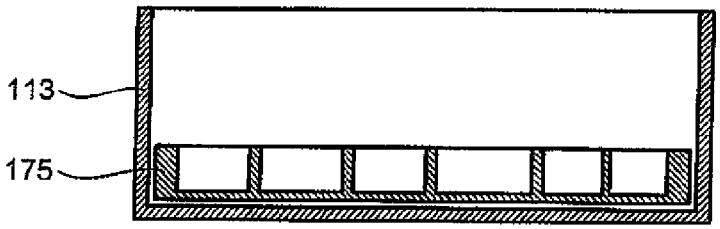

FIGS. 9A-9C and 10A-10C illustrate examples in which wrapped coin rolls are stored in the drawer 113 by a method other than the method illustrated in FIGS. 8A-8C. FIGS. 9A-9C illustrate examples in which the opening on the upper surface is formed into an elongated hole shape, and FIGS. 10A-10C illustrate examples in which the opening on the upper surface is formed into a rectangular hole shape. These examples are different from the storage methods illustrated in FIGS. 8A-8C in a point that a plurality of wrapped coin rolls is inserted in one opening.

A plurality of openings with an elongated-hole shape, into which a predetermined number of wrapped coin rolls can be entirely inserted, is provided by denomination on the upper surface of a wrapped coin storage tray 174 illustrated in FIGS. 9A-9C. By inserting the wrapped coin rolls into those openings, the wrapped coin rolls are stored in a state in which the wrapped coin roll stands upright inside the drawer 113. In the wrapped coin storage tray 174, four openings for respectively inserting four wrapped coin rolls of 1-cent coins, four openings for respectively inserting four wrapped coin rolls of 5-cent coins, four openings for respectively inserting four wrapped coin rolls of 10-cent coins, four openings for respectively inserting three wrapped coin rolls of 25-cent coins, one opening for respectively inserting three wrapped coin rolls of 50-cent coins, and one opening for respectively inserting three wrapped coin rolls of 1-dollar coins are provided. By storing the plurality of wrapped coin rolls in a state in which the rolls are in close contact with one another in one line, the numbers of wrapped coin rolls of 1-cent, 5-cent, 10-cent, and 25-cent coins that can be stored in the drawer are larger than those in the examples illustrated in FIGS. 8A-8C.

A plurality of openings with a rectangular-hole shape, into which a predetermined number of wrapped coin rolls can be entirely inserted, is provided by denomination on the upper surface of a wrapped coin storage tray 175 illustrated in FIGS. 10A-10C. By inserting the wrapped coin rolls into those openings, the wrapped coin rolls are stored in a state in which the wrapped coin roll stands upright inside the drawer 113. In the wrapped coin storage tray 175, three openings for respectively inserting four wrapped coin rolls of 1-cent coins, three openings for respectively inserting four wrapped coin rolls of 5-cent coins, three openings for respectively inserting four wrapped coin rolls of 10-cent coins, three openings for respectively inserting four wrapped coin rolls of 25-cent coins, two openings for respectively inserting two wrapped coin rolls of 50-cent coins, and two openings for respectively inserting two wrapped coin rolls of 1-dollar coins are provided. For the wrapped 5-cent and 25-cent coin rolls, by storing plural wrapped coin rolls in a state in which they are in close contact with one another in two directions of the front-rear direction and the left-right direction, the numbers of wrapped coin rolls that can be stored are larger than those in the examples illustrated in FIGS. 8A-8C.

Because the drawers 111 to 113 have the same structure, the respective drawers 111 to 113 provided in vertically three stages can be used by any method selected from those illustrated in FIGS. 5, 6A-6C, 7A-7C, 8A-8C, 9A-9C and 10A-10C. The denomination and the number of stored banknotes and coins illustrated in FIGS. 6A-6C, 7A-7C, 8A-8C, 9A-9C, and 10A-10C are mere examples, and the structure of the trays 171 to 175 can be modified in accordance with the necessary denomination and the number of banknotes and coins to be stored.

The manually-handled money storage unit 100 can be used in a manner similar to that of a drawer provided in a conventional teller counter. For example, at the start of a day's services in the bank branch 1, the total amount of the banknotes and the coins that have been stored in the manually-handled money storage unit 100 and the mechanical processing unit 200 of the money handling apparatus 10 is verified, and the verified amount is recorded in the operation terminal 11 and/or the mechanical processing unit 200.

After the services have been started in the bank branch 1, the teller, in response to a request from a customer, can perform a process by using the mechanical processing unit 200 of the money handling apparatus 10 and/or by using the manually-handled money storage unit 100. Processes performed by using the mechanical processing unit 200 are similar to processes performed by using a conventional money processing apparatus as described above.

In performing a process by using the manually-handled money storage unit 100, for example, if the teller has received money and has been requested to deposit the received money to the customer's bank account, the teller performs the processing for depositing the money to the customer's bank account by operating the bank terminal 22 illustrated in FIG. 1. Then the teller stores the money received from the customer in the corresponding drawer 111, 112, 113 of the manually-handled money storage unit 100. If a teller has been requested by a customer to dispense money from the customer's bank account, the teller performs a processing for dispensing the money from the bank account by operating the bank terminal 22 illustrated in FIG. 1, and then takes out the money to be dispensed from the corresponding drawer 111, 112, or 113 of the manually-handled money storage unit 100 and hands the money to the customer.

As described above, the banknotes and coins stored in the drawers 111 to 113 of the manually-handled money storage unit 100 and the banknotes and the coins taken out from the drawers 111 to 113 can be excluded from the object of mechanical management by the money handling apparatus 10, and thereby the drawers 111 to 113 can be used in a manner similar to that of conventional drawers provided to the teller counter.

After a day's services have been completed, the amount deposited by the teller into the money handling apparatus 10 and the amount dispensed by the teller from the money handling apparatus 10 can be calculated by using the bank terminal 22 on the basis of the history of the day's transactions. The total amount of the banknotes and the coins that should be stored in the money handling apparatus 10 after the day's services are completed can be calculated on the basis of the amount determined in the above-described manner and the total amount of the banknotes and the coins that have been stored in the mechanical processing unit 200 and the manually-handled money storage unit 100 of the money handling apparatus 10 at the time of start of the day's services. Further, because the denomination and the number of the banknotes that have been stored in the mechanical processing unit 200 are mechanically managed, the amount that should be stored in the manually-handled money storage unit 100 after the day's services are completed can be calculated. With this configuration, the teller can verify, after the day's services are completed, whether the services have been done without any problem by merely verifying the total amount of the banknotes and the coins stored in the manually-handled money storage unit 100. In addition, in this verification, because mechanically receivable banknotes, among the banknotes that have been stored in the manually-handled money storage unit 100, can be counted by depositing them in the mechanical processing unit 200, the teller is only required to verify the banknotes and coins that cannot be processed by the mechanical processing unit 200 only.

As described above, the money handling apparatus 10 can be used independently from a network constituted by the bank terminal 22 and the bank server 21 whereby the money handling apparatus 10 can be introduced while the systems conventionally used in the bank branches 1 are maintained as conventional as they are. In addition, while good banknotes are processed by using the mechanical processing unit 200, banknotes that are in so poor states that they cannot be mechanically received and coins that cannot be processed by the mechanical processing unit 200 can be processed by using the manually-handled money storage unit 100. In addition, in the manually-handled money storage unit 100, the drawers 111 to 113 can be used for the banknotes and the coins that have been stored in the respective drawers 111 to 113 without mechanically managing the banknotes and the coins. Because the drawers 111 to 113 can be used in the same manner as to the conventional drawers installed to the teller counter, it is enabled to flexibly respond to the desire and the state in the bank branch 1. For example, even after installation of the money handling apparatus 10, a part of transactions and operations performed before the installation can be kept as they are, or the drawers 111 to 113 can be used until the teller becomes accustomed to operation of the money handling apparatus 10.

The method of using the drawers 111 to 113 is not limited to a configuration in which they are used in a manner similar to that of conventional drawers installed to the teller counter, and in the money handling apparatus 10, the money stored in the drawers 111 to 113 can also be subjects of mechanical management.

Figure 11:
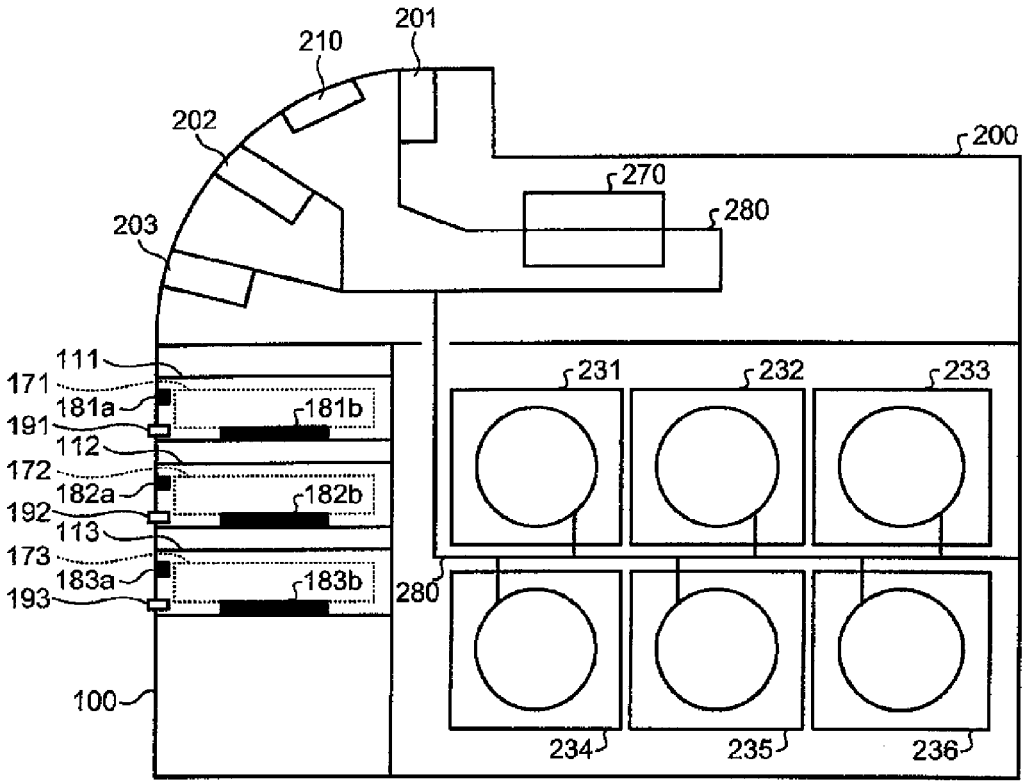
FIG. 11 is a view that illustrates an outline inner configuration of the money handling apparatus that manages the amount of money stored in the manually-handled money storage unit.

FIG. 11 is a cross-sectional schematic diagram illustrating an outline inner configuration of the manually-handled money storage unit 100 in addition to the configuration illustrated in FIG. 4. The drawer 111 of the manually-handled money storage unit 100 is provided with a first drawer open/close state detection unit 181*a* that detects an open/close state of the drawer 111, a first drawer storage amount detection unit 181*b* that detects the amount of coins stored in the drawer 111, and a first drawer notification unit 191 that notifies information about the drawer 111. Similarly, the drawer 112 is provided with a second drawer open/close state detection unit 182*a*, a second drawer storage amount detection unit 182*b*, and a second drawer notification unit 192. Similarly, the drawer 113 is provided with a third drawer open/close state detection unit 183*a*, a third drawer storage amount detection unit 183*b* that detects the storage amount of the coin in the drawer 113, and a third drawer notification unit 193 that notifies information about the drawer 113.

The first to the third drawer open/close state detection units 181*a* to 183*a* detect the difference in the brightness level inside the drawer between the brightness level in the drawer-opened state and that in the drawer-closed state to detect the open/close state of the drawers 111 to 113. Alternatively, for example, the first to the third drawer open/close state detection units 181*a* to 183*a* may be configured to detect the open/close state of the drawers 111 to 113 by detecting the positional change of the drawer between the position of the drawer in the drawer-opened state and that in the drawer-closed state.

The first to the third drawer storage amount detection units 181*b* to 183*b* determine, for example, the weight of the support tray 171 provided in the drawer 111, the banknote storage tray 172 provided in the drawer 112, and the wrapped coin storage tray 173 provided in the drawer 113 by using a load cell and the like to detect the storage amount of the money. By previously registering the denomination, the weight, and the like of the money to be stored by using the trays 171 to 173, the storage amount of the money can be detected on the basis of the weight. Alternatively, for example, the first to the third drawer storage amount detection units 181*b* to 183*b* may be configured to capture images of the banknotes and the coins deposited to and dispensed from the drawers 111 to 113 by using a camera and manage the storage amount of the money by analyzing the obtained images. Further alternatively, for example, the first to the third drawer storage amount detection units 181*b* to 183*b* may be configured, for loose coins and wrapped coin rolls, so that the detection units optically scan the inside of the storage unit from above to determine the height of the storage unit, and that if the determined height is equal to or lower than the height of the coin counter 300 or equal to or lower than the height of the wrapped coin storage tray 173, then the detection units determine that no object has been stored, and if the determined height is higher than the height of the coin counter 300 and the height of the wrapped coin storage tray 173, then the detection units determine that stored objects have been present therein. By previously registering and using information about the loose coins and the wrapped coin rolls to be stored such as the denomination, the storage amount of the coins can be detected based on the determination results. Because the denomination of coins can be determined by optically detecting the diameter of the coins in the case of loose coins and wrapped coin rolls, the storage amount of the coins can also be detected on the basis of the results of determination of the presence or absence of stored objects and on the basis of the determination results of the denomination of the coins.

The first to the third drawer notification units 191 to 193 are respectively constituted by a light emitting device such as a light-emitting diode (LED), and are configured to notify information on the basis of changes in the state of a monochromatic LED such as an OFF state, a flashing state, and an ON state. Alternatively, the first to the third drawer notification units 191 to 193 may be configured to notify the information on the basis of changes of colors by using a multicolor LED capable of emitting multicolor lights.

Figure 12:
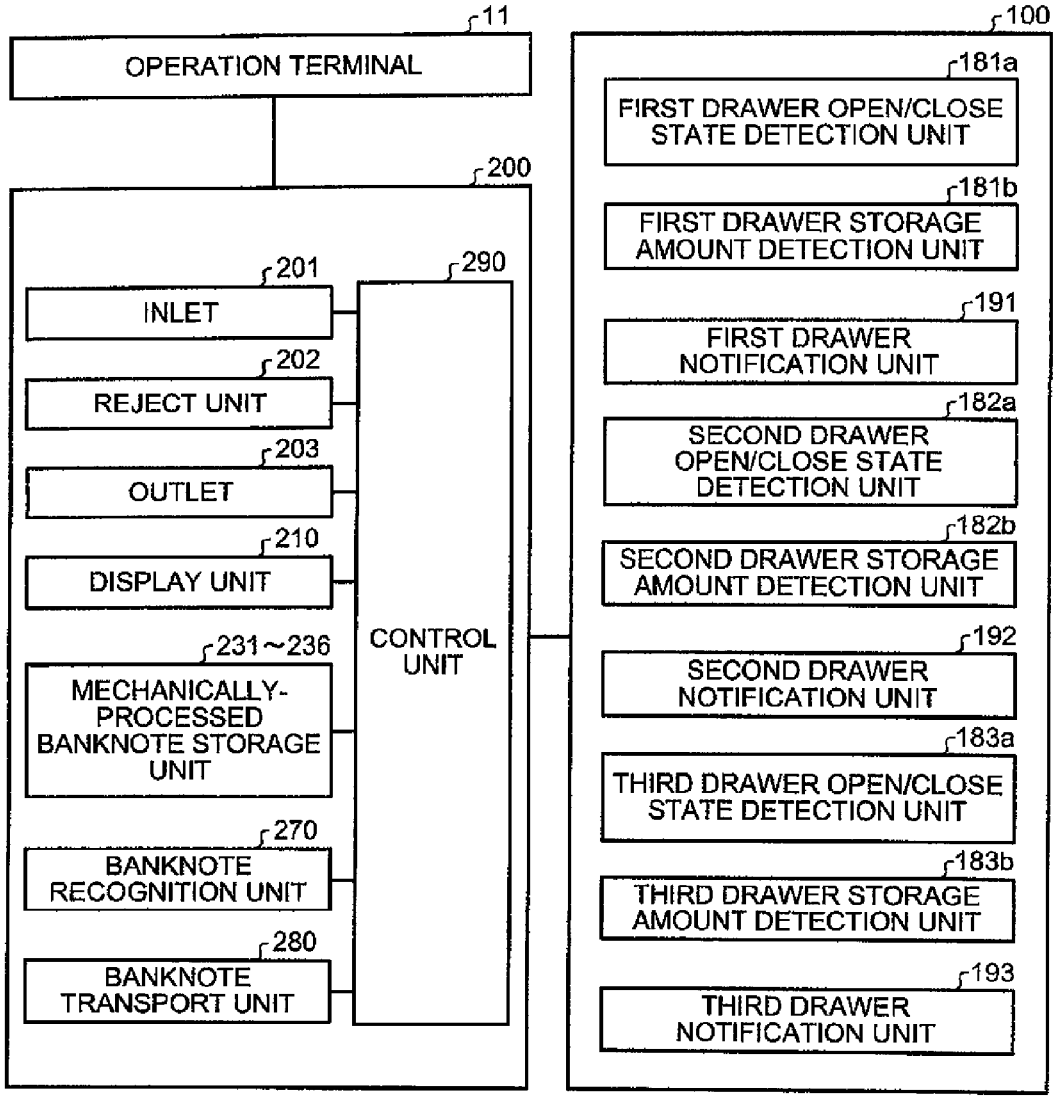
FIG. 12 is a view that illustrates an outline functional configuration of the money handling apparatus that manages money in the mechanical processing unit and money stored in the manually-handled money storage unit.

FIG. 12 is a block diagram that illustrates an outline functional configuration of the money handling apparatus 10 illustrated in FIG. 11. In the mechanical processing unit 200 of the money handling apparatus 10, mechanical processes such as a counting process, a depositing process, and a dispensing process are implemented by a control unit 290 by controlling operations of the inlet 201, the reject unit 202, the outlet 203, the mechanically-processed banknote storage units 231 to 236, the banknote recognition unit 270, and the banknote transport unit 280 in accordance with the operations performed at the operation terminal 11 that is connected to the network. To the control unit 290, detection results by the first to the third drawer open/close state detection units 181*a* to 183*a* and the first to the third drawer storage amount detection units 181*b* to 183*b* provided to the drawers 111 to 113 of the manually-handled money storage unit 100 are input. In addition, the first to the third drawer notification units 191 to 193 are connected to the control unit 290, and notification processes by the first to the third drawer notification units 191 to 193 are performed on the basis of the control by the control unit 290. The control unit 290 may also use the display unit 210 in addition to the first to the third drawer notification units 191 to 193 for the notification process. The control unit 290 stores and manages a variety of information such as settings and data necessary for executing respective processes by using non-volatile storage devices such as a semiconductor memory (not illustrated) and the like.

The denomination and the like of the money to be stored in the drawers 111 to 113 are previously set. By previously inputting and using information such as the denomination of the money to be stored in the respective drawers 111 to 113 and the weight of the money with this denomination by operating the operation terminal 11, on the basis of the inputted information, the control unit 290 detects the storage amount of the money stored in the respective drawers 111 to 113 by carrying out determination of the weight and the like by using the first to the third drawer storage amount detection units 181*b* to 183*b*. At a timing at which the denomination of the money to be deposited or dispensed is recognized, the control unit 290 controls the first to the third drawer notification units 191 to 193 to notify the location of the drawer 111, 112, or 113 that corresponds to the money to be deposited or dispensed. The notification process is performed by lighting or flashing the LED, which is normally in an OFF state, for example.

In the money handling apparatus 10 having a configuration shown in FIGS. 11 and 12, in performing a process by using the manually-handled money storage unit 100, for example, the teller, who has received money from the customer and has been requested by the customer to deposit the money to the customer's bank account, operates the bank terminal 22 illustrated in FIG. 1 to perform the process for depositing the money to the bank account. Then the teller stores the received money into the corresponding drawer 111, 112, or 113 of the manually-handled money storage unit 100. When it is detected the drawers 111, 112 or 113 has been opened and closed on the basis of the detection results by the first to the third drawer open/close state detection units 181*a* to 183*a*, the control unit 290 detects the amount of the money stored in the drawer, in which the money to be deposited has already been stored, by using the storage amount detection unit provided to the drawer of which the opened and the closed state has been detected. In the above-described manner, it is enabled to manage the storage weight (amount) of the banknotes and the coins that have been stored in the manually-handled money storage unit 100 by using the control unit 290.

When storing the money into the manually-handled money storage unit 100, the teller can operate the operation terminal 11 and input the denomination and the amount of the money to be stored. For example, if the teller has inputted the denomination and the amount of the money to be stored into the manually-handled money storage unit 100 to the operation terminal 11, then the control unit 290 controls the first to the third drawer notification units 191 to 193 to notify the location of the drawers 111 to 113 in which the money is to be stored to the teller. The teller opens the notified drawer 111, 112, or 113 and stores the money therein. When the control unit 290 detects that the drawer 111, 112, or 113 has been opened and closed on the basis of the detection results by the first to the third drawer open/close state detection units 181*a* to 183*a*, after the money has been already stored therein, the control unit 290 detects the amount of the money stored in the drawer by using the storage amount detection unit provided to the drawer of which the opened and the closed state has been detected.

For example, an LED provided as the first, the second or the third drawer notification unit on the drawers 111, 112, or 113, which is to store the money to be deposited therein, is turned on. After the money has been stored, the control unit 290 carries out a comparison between the information, which has been previously inputted to the operation terminal 11 and includes the denomination and the amount of the money to be deposited, and the detection result for the money that has been actually stored. Tf the inputted information and the detection result do not match as a result of the comparison, the control unit 290 displays information that indicates the comparison result on the operation terminal 11. In addition, the control unit 290 performs notification by using the first to the third drawer notification units 191 to 193. Specifically, the LED that has been turned on to notify the location of the drawer is turned off if the information and the detection result match one another as a result of the comparison, while if they do not match one another, the LED flashes. After the teller corrects the previously inputted information about the money to be deposited and performs the operations for verifying the money to be stored in the drawers 111 to 113, if the corrected information and the stored money match one another, the control unit 290 recognizes this comparison result, displays information indicating the comparison result on the operation terminal 11, and turns off the LED. The notification of the location of the drawers 111 to 113 and the comparison result can be performed also by using the display unit 210 in addition to or instead of the operation terminal 11 and the first to the third drawer notification units 191 to 193.

Alternatively, either one of the denomination and the amount of the money, which is to be deposited and stored in the drawers 111 to 113, can be input to the operation terminal 11. If only the denomination has been inputted to the operation terminal 11, the control unit 290 notifies the location of the drawer 111, 112, or 113 in which the money is to be stored to the teller by controlling the first to the third drawer notification units 191 to 193. Then, the control unit 290 performs the process for comparing the denomination of the money to be deposited, which has been previously inputted, with the denomination of the money that has been actually stored. In contrast, if only the amount of the money to be deposited has been inputted to the operation terminal 11, the notification of the location of the drawer 111, 112, or 113 in which the money is to be stored is not performed, and the process for comparing the previously inputted amount and the amount of the money that has been actually stored is performed. The control unit 290 displays the comparison result on the operation terminal 11. If the comparison result indicates that the amounts do not match, the control unit 290 controls the first to the third drawer notification units 191 to 193 to notify the location of the drawer 111, 112, or 113 that require re-verification for the stored money. When the comparison result indicates that the amounts match due to the verification and other operation performed by the teller, the notification is canceled.

If the teller has been requested by the customer to dispense money from the customer's bank account, the teller operates the bank terminal 22 illustrated in FIG. 1 and performs the process for dispensing the money from the customer's bank account, and takes out the money from the corresponding drawer 111, 112, or 113 of the manually-handled money storage unit 100. If it is detected on the basis of the detection result by the first to the third drawer open/close state detection units 181*a* to 183*a* that the drawer 111, 112, or 113 has been opened and closed, the control unit 290 detects the storage amount of the money in the drawer after the money to be dispensed has been taken out by using the storage amount detection unit arranged in the drawer. The control unit 290 determines the amount of money, which has been taken out as the money to be dispensed, on the basis of the detection result. With this configuration, it is enabled to manage the storage weight (amount) of the banknotes and the coins stored in the manually-handled money storage unit 100 by using the control unit 290.

When taking out the money from the manually-handled money storage unit 100, the teller can also operate the operation terminal 11 to input the denomination and the amount of the money to be dispensed. For example, if the teller has inputted the denomination and the amount of the money to be dispensed to the operation terminal 11, the control unit 290 notifies the location of the drawer 111, 112, or 113, in which the money to be taken out has been stored, to the teller by controlling the first to the third drawer notification units 191 to 193. The teller opens the notified drawer 111, 112, or 113 and takes out the money to be dispensed. The control unit 290 detects that the drawer 111, 112, or 113 has been opened and closed on the basis of the detection results by the first to the third drawer open/close state detection units 181*a* to 183*a* and detects the storage amount of the money in the drawer after the money to be dispensed has been already taken out therefrom by using the storage amount detection unit provided to the drawer. The control unit 290 determines the amount of money that has been taken out as the money to be dispensed on the basis of the detection result. Further, similarly to the case of the depositing process, the control unit 290 compares the denomination and the amount of the money to be dispensed that have been previously inputted to the operation terminal 11 and the denomination and the amount of the money that has been actually taken out. If they do not match one another, the control unit 290 displays the information on the operation terminal 11 and controls the first to the third drawer notification units 191 to 193 to flash so as to notify this status to the teller. After the teller corrects the previously inputted information about the money to be dispensed and performs the operations for verifying the money to be taken out from the drawers 111 to 113, if the corrected information and the money that has been taken out match one another, the control unit 290 recognizes this comparison result, displays information indicating the comparison result on the operation terminal 11, and turns off the LED.

Alternatively either one of the denomination and the amount of the money, which is to be dispensed and taken out from the drawers 111 to 113, can be input to the operation terminal 11. If only the denomination has been inputted to the operation terminal 11, the control unit 290 notifies the location of the drawer 111, 112, or 113 from which the money is to be taken out to the teller by controlling the first to the third drawer notification units 191 to 193. Then the control unit 290 performs the process for comparing the denomination of the money to be dispensed, which has been previously inputted, with the denomination of the money that has been actually taken out. If only the amount has been inputted to the operation terminal 11, the notification of the location of the drawer 111, 112, or 113 from which the money is to be taken out is not performed, and the process for comparing the previously inputted amount and the amount of the money that has been actually taken out from the drawer 111, 112, or 113 is performed. The control unit 290 displays the comparison result on the operation terminal 11. If the comparison result indicates that the amounts do not match, the control unit 290 controls the first to the third drawer notification units 191 to 193 to notify the location of the drawer 111, 112, or 113 that require re-verification for the taken out money. When the comparison result indicates that the amounts match due to the verification and other operations performed by the teller, the notification is canceled.

As described above, the manually-handled money storage unit 100 is capable of notifying the location of the drawers 111 to 113 in which the money for the deposit process is to be stored and the location of the drawers 111 to 113 from which the money for the dispensing process is to be taken out. Therefore the teller can easily perform the deposit process and the dispensing process by using the manually-handled money storage unit 100. In addition, by detecting the open/close state of the drawers 111 to 113 of the manually-handled money storage unit 100 and the amount of money stored therein, the deposited money to be stored in the manually-handled money storage unit 100 and the dispensing money to be taken out from the manually-handled money storage unit 100 can be recognized and managed mechanically. With this configuration, the money to be deposited and the money to be dispensed can be strictly mechanically managed by using the drawers 111 to 113.

Figure 13E:
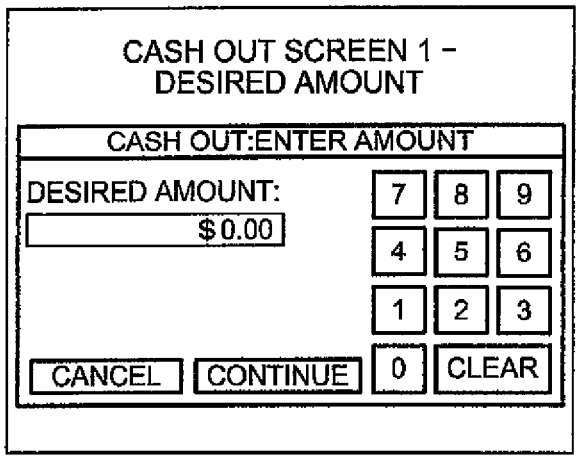

FIGS. 13A, 135, 13C, 13D, 13E, 13F, and 13G illustrate examples of a screen for describing a main menu displayed on the operation terminal 11 when the money handling apparatus 10 is used by operating the operation terminal 11. FIG. 13A illustrates a log-on screen displayed at the start of use of the money handling apparatus 10. The teller operates the operation terminal 11 and inputs a user name and a password, which are identification (ID) that has been assigned to the respective tellers, and thereby the teller who uses the money handling apparatus 10 is identified. Information for identifying the teller is inputted also on the bank terminal 22, and thus the information about the actual money that has been processed by using the money handling apparatus 10 and the information about the money that has been processed by using the bank terminal 22 with respect to the bank account can be collated.

FIG. 13B illustrates a main menu screen displayed after the teller has logged on. In the main menu, a "COUNT" button corresponding to the counting process, a "CASH IN" button corresponding to the depositing process, a "CASH OUT" button corresponding to the dispensing process, a "LOCK" button for locking the operation of the mechanical processing unit 200 of the money handling apparatus 10 when the teller leaves the teller counter, and an "ADMINISTRATION" button for displaying a management menu are displayed.

FIG. 13C illustrates an example of a screen display of counting results, which is displayed when the teller presses the "COUNT" button on the main menu screen illustrated in FIG. 13B to perform the counting process by the mechanical processing unit 200. The banknotes that have been received in the inlet 201 are transported by the banknote transport unit 280 sheet by sheet, then the denomination and the authenticity are recognized by the banknote recognition unit 270, and then the banknotes are discharged to the outlet 203. On the screen of the operation terminal 11, the number and the amount of the banknotes are displayed by denomination and the total amount of all the banknotes is displayed. By pressing a "COUNT MORE" button on the screen illustrated in FIG. 13C, the counting process for additional banknotes received in the inlet 201 can be performed. When a "CANCEL" button is pressed, the screen returns to the main menu screen illustrated in FIG. 13B.

FIG. 13D illustrates an example of a screen display of results, which is displayed when the "CASH IN" button is pressed on the main menu screen illustrated in FIG. 13B to perform the depositing process by the mechanical processing unit 200. The banknotes to be deposited that have been received in the inlet 201 are transported by the banknote transport unit 280 sheet by sheet, then the denomination and the authenticity are recognized by the banknote recognition unit 270, and then the banknotes are stored in the corresponding mechanically-processed banknote storage units 231 to 236. On the screen of the operation terminal 11, the number and the amount of the banknotes are displayed by denomination and the total amount of the banknotes to be deposited is displayed. By pressing a "MORE CASH" button on the screen illustrated in FIG. 13D, additional banknotes to be deposited received in the inlet 201 can be counted. When a "FINISH" button is pressed, the depositing process is confirmed, and when a "CANCEL" button is pressed, the depositing process is canceled and the screen returns to the main menu screen illustrated in FIG. 13B. If the depositing process has been confirmed, the information about the banknotes that have been stored in the mechanical processing unit 200 is updated on the basis of the results of the recognition and the counting by the banknote recognition unit 270. If the depositing process has been canceled, the results of the recognition and the counting are discarded, and all the banknotes that have been stored in the mechanically-processed banknote storage units 231 to 236 for the depositing process are discharged to the outlet 203. Rejected banknotes that could not be processed mechanically in the depositing process and therefore discharged to the reject unit 202 can be stored in the corresponding drawers 111 to 113 of the manually-handled money storage unit 100.

FIG. 13E illustrates a screen, which is displayed when the "CASH OUT" button is pressed on the main menu screen illustrated in FIG. 13B to start the dispensing process by the mechanical processing unit 200. First, when a "CONTINUE" button is pressed after inputting the amount to be dispensed on this screen, the screen shifts to a screen illustrated in FIG. 13F. If a "CANCEL" button has been pressed, the dispensing process is canceled, and the screen returns to the main menu screen illustrated in FIG. 13B.

Figure 13F:
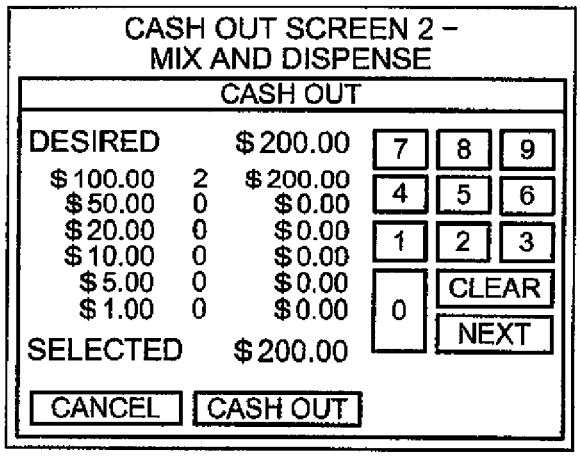

Via the screen illustrated in FIG. 13F, the breakdown of the denomination and the number (amount) of the banknotes for dispensing the banknotes of the previously inputted amount can be designated. In an upper portion of the screen, the previously inputted amount to be dispensed is displayed in a "DESIRED" field. By operating the buttons on the screen, the teller inputs the number or the amount of the banknotes for the respective denomination. In a lower portion of the screen, the total amount of the banknotes selected via the screen is displayed in a "SELECTED" field. When a "CASH OUT" button is pressed after the input for the breakdown of the money to be dispensed has been completed, a dispensing operation by the mechanical processing unit 200 is started, and the banknotes of the designated denomination and number (amount) are fed from the mechanically-processed banknote storage units 231 to 236 to be discharged to the outlet 203. When the dispensing process is completed, the information about the banknotes having been stored inside the mechanical processing unit 200 is updated. If the "CANCEL" button has been pressed, the dispensing process is canceled, and the screen returns to the main menu screen illustrated in FIG. 13B.

Figure 13G:
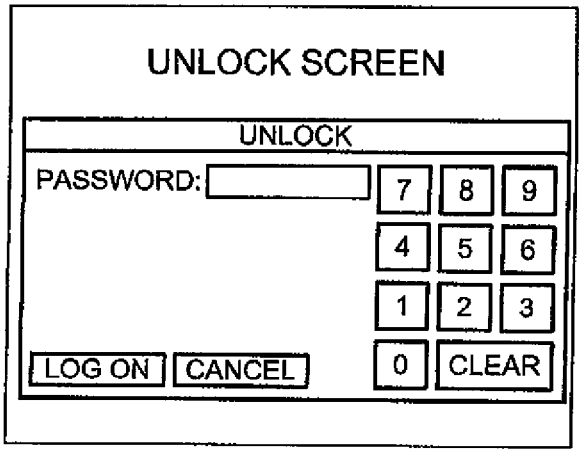

FIG. 13G illustrates a screen, which is displayed when the operation of the mechanical processing unit 200 has been locked by pressing the "LOCK" button on the main menu screen illustrated in FIG. 13B. By inputting the password via this screen, the locked state of the mechanical processing unit 200 is released and the main menu screen illustrated in FIG. 13B is displayed, and thus the status of the apparatus shifts to a status in which the respective processes can be started.

Figure 14A:
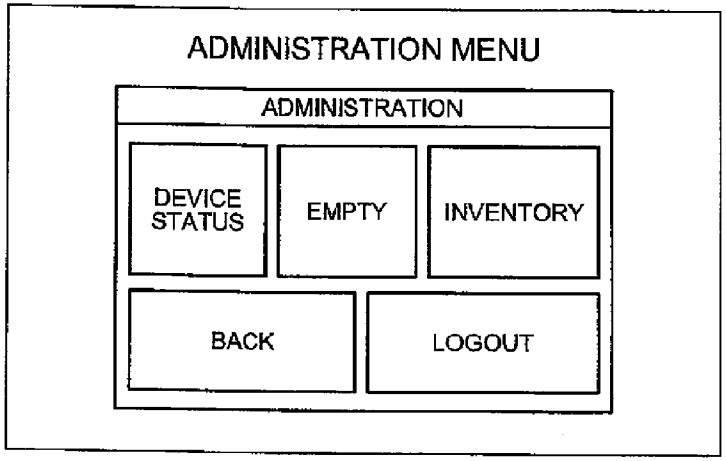

FIGS. 14A, 14B, 14C, and 14D illustrate examples of a screen for describing a management menu. FIG. 14A illustrates a management menu screen displayed when the "ADMINISTRATION" button is pressed on the main menu screen illustrated in FIG. 13B. On the management menu screen, a "DEVICE STATUS" button for verifying the operation status of the mechanical processing unit 200 of the money handling apparatus 10, an "EMPTY" button for emptying the inside of the mechanical processing unit 200 by collecting all the banknotes from the mechanically-processed banknote storage units 231 to 236, an "INVENTORY" button for verifying the denomination and the amount of all the banknotes having been stored in the mechanically-processed banknote storage units 231 to 236, a "BACK" button for returning to the main menu screen, and a "LOGOUT" button for logging out are displayed.

Figure 14B:
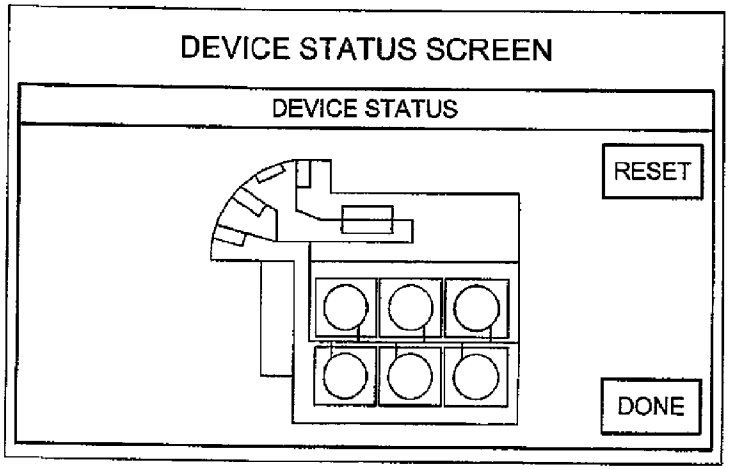

FIG. 14B illustrates an example of a screen displayed when the "DEVICE STATUS" button is pressed on the main menu screen illustrated in FIG. 14A. The mechanical processing unit 200 includes detection sensors for detecting errors and failures occurring in the units and portions of the apparatus, such as sensors for detecting transport errors. If any error or failure has been detected by the detection sensors, the location of the sensor that has detected the error or the failure and related information are displayed on a graphic display of the mechanical processing unit 200 on the screen. If a "RESET" button has been pressed, the detected information is reset, and if a "DONE" button has been pressed, the screen returns to the management menu screen illustrated in FIG. 14A.

Figure 14C:
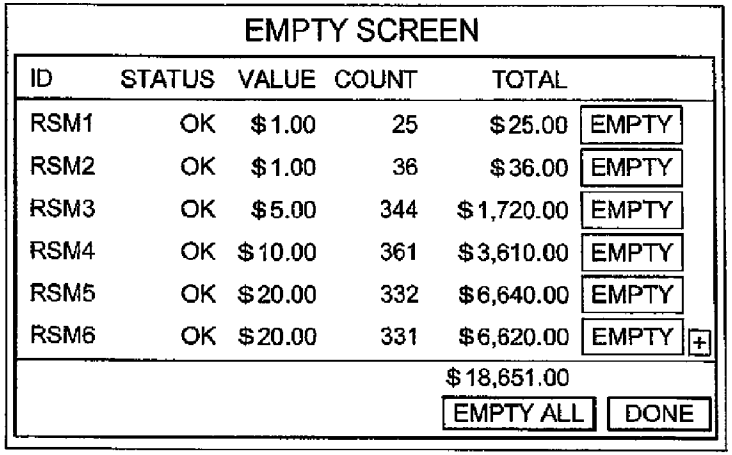

FIG. 14C illustrates an example of a screen displayed when an "EMPTY" button has been pressed on the main menu screen illustrated in FIG. 14A. On the screen, the denomination, the number, and the total amount of the banknotes stored in the respective mechanically-processed banknote storage units 231 to 236 in the mechanical processing unit 200; and the total amount of all the banknotes that have been stored in the mechanically-processed banknote storage units 231 to 236 are displayed. On the screen, IDs RSM1 to RSM6 correspond to the mechanically-processed banknote storage units 231 to 236, respectively. In addition, in "STATUS" fields on the screen, information about whether banknotes can be stored in the respective mechanically-processed banknote storage units 231 to 236 is displayed. If "OK" is displayed, banknotes can be stored. While if "FULL" indicating a full state or "ERROR" indicating that an error has been detected is displayed, no banknote can be additionally stored therein. If the "EMPTY" button corresponding to the respective mechanically-processed banknote storage units 231 to 236 is pressed on the screen, all the banknotes that have been stored in the corresponding storage unit are fed out and discharged to the outlet 203. If an "EMPTY ALL" button has been pressed, the banknotes are serially discharged from the respective mechanically-processed banknote storage units 231 to 236 until all the banknotes are discharged from the mechanical processing unit 200. If a "DONE" button has been pressed, the screen returns to the management menu screen illustrated in FIG. 14A.

Figure 14D:
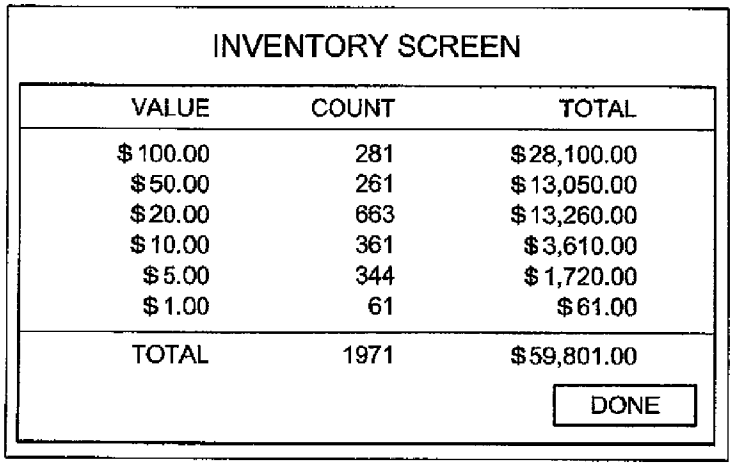

FIG. 14D illustrates an example of a screen displayed when an "INVENTORY" button has been pressed on the main menu screen illustrated in FIG. 14A. On the screen, the denomination, the number, and the total amount of the banknotes stored in the respective mechanically-processed banknote storage units 231 to 236; and the total amount of all the banknotes that have been stored in the mechanically-processed banknote storage units 231 to 236 are displayed. If the "DONE" button has been pressed, the screen returns to the management menu screen illustrated in FIG. 14A.

In the money handling apparatus 10, when mechanically managing the banknotes and the coins that have been stored in the manually-handled money storage unit 100 in the manner described above with reference to FIGS. 11 and 12, a setting can be performed so that the control unit 290 performs a control for adjusting the amount of the money that has been stored in the manually-handled money storage unit 100 to a previously set amount. A specific example will be described below with reference to an exemplary case where the drawer 113, which is managed in the manually-handled money storage unit 100 as a drawer No. 3, is used for storing banknotes, and the storage amount has been managed so that the number of $20 banknotes may be 20 and the number of $10 banknotes may be 10, for example.

When the "CASH IN" button has been pressed on the main menu screen illustrated in FIG. 13B and thus the depositing process is started, the control unit 290 verifies the number of $20 banknotes stored in the drawer 113. Then, for example, if the number of the $20 banknotes stored in the drawer 113 is fifteen, the control unit 290 controls the banknote transport unit 280 to transport and discharge $20 banknotes included in the deposited banknotes to the outlet 203 on the basis of the results of the recognition by the banknote recognition unit 270, so that the number of the $20 banknotes stored in the drawer 113 may become twenty. For example, if five $20 banknotes have been included in the deposited money, all the $20 banknotes are discharged to the outlet 203. Then, as illustrated in FIG. 15A, the control unit 290 displays information on the screen to prompt the teller to store the five $20 banknotes having been discharged to the outlet 203 in the drawer 113, and notifies the location of the drawer in which the $20 banknotes are to be stored by turning on the third drawer notification unit 193 provided to the drawer 113. Having recognized the notification, the teller stores the five $20 banknotes discharged in the outlet 203 into the notified drawer 113, and thereby the number of $20 banknotes stored in the drawer 113 can be adjusted to twenty, which is the previously set number.

After it has been detected by the third drawer open/close state detection unit 183*a* and the third drawer storage amount detection unit 183*b* that five $20 banknotes have been stored in the drawer 113, the information about the storage amount of the $20 banknotes stored in the manually-handled money storage unit 100 is updated. Also, the storage amount of the banknotes in the mechanical processing unit 200 is updated on the basis of the denomination and the number of the banknotes that have been stored in the mechanical processing unit 200.

Banknotes other than the banknotes necessary for adjusting the storage amount in the manually-handled money storage unit 100 are stored in either one of the corresponding mechanically-processed banknote storage units 231 to 236. For example, if five $20 banknotes are to be deposited and if eighteen $20 banknotes have been stored in the drawer 113, then the amount of stored $20 banknotes is controlled to be twenty, the previously set storage amount, by storing three $20 banknotes into either one of the corresponding mechanically-processed banknote storage units 231 to 236, and two $20 banknotes only are discharged to the outlet 203.

In the above-described manner, on the basis of the denomination and the number (amount) of the money previously set to be stored into the respective drawers 111 to 113 and the denomination and the number (amount) of the money having been actually stored in the respective drawers 111 to 113, the control unit 290 determines which of the mechanically-processed banknote storage units 231 to 236 in the mechanical processing unit 200 and the drawers 111 to 113 of the manually-handled money storage unit 100 the banknotes having been recognized by the banknote recognition unit 270 are to be stored in. With the above-described configuration, the denomination and the number (amount) of the money stored in the drawers 111 to 113 of the manually-handled money storage unit 100 can be controlled to match the previously set content.

Similarly, when the total amount and the like of the banknotes to be dispensed have been set after the dispensing process has been started by pressing the "CASH OUT" button on the main menu screen illustrated in FIG. 13B, the control unit 290 verifies the denomination and the number of the banknotes that have been stored in the drawer 113. For example, if it is set that ten $10 banknotes are to be dispensed in the dispensing process while twenty $10 banknotes have been stored in the drawer 113, the control unit 290, in order to adjust the storage amount to ten, does not feed $10 banknotes from the mechanically-processed banknote storage units 231 to 236, displays information as illustrated in FIG. 15B to prompt the teller to take out the $10 banknotes from the drawer 113, and turns on the third drawer notification unit 193 provided to the drawer 113. Having recognized the notification, the teller takes out ten $10 banknotes from the notified drawer 113 as the banknotes to be dispensed, and thus the storage amount of the $10 banknotes in a drawer 113 can be adjusted to ten, the previously set number.

After it has been detected by the third drawer open/close state detection unit 183*a* and the third drawer storage amount detection unit 183*b* that ten $10 banknotes have been taken out from the drawer 113, the information about the storage amount of the $10 banknotes having been stored in the manually-handled money storage unit 100 is updated. Also, the storage amount of the banknotes in the mechanical processing unit 200 is updated on the basis of the denomination and the number of the banknotes that have been discharged from the mechanical processing unit 200.

Banknotes other than the banknotes necessary for adjusting the storage amount in the manually-handled money storage unit 100 are discharged from either one of the corresponding mechanically-processed banknote storage units 231 to 236. For example, if five $10 banknotes have been designated as the banknotes to be dispensed and if twelve $10 banknotes have been stored in the drawer 113, then the amount of stored $10 banknotes is controlled by the control unit 290 to be ten by performing a control for taking out two $10 banknotes from the drawer 113, and three $10 banknotes are discharged from the storage unit of either one of the corresponding mechanically-processed banknote storage unit 231 to 236 to the outlet 203.

In the above-described manner, on the basis of the breakdown of the banknotes to be dispensed, the denomination and the number (amount) of the money previously set to be stored into the respective drawers 111 to 113, and the denomination and the number (amount) of the money having been actually stored in the respective drawers 111 to 113, the control unit 290 determines which of the mechanically-processed banknote storage units 231 to 236 in the mechanical processing unit 200 and the drawers 111 to 113 of the manually-handled money storage unit 100 the banknotes to be dispensed are to be dispensed from. With the above-described configuration, the denomination and the number (amount) of the money stored in the drawers 111 to 113 of the manually-handled money storage unit 100 can be controlled so as to match the previously set content.

If the banknotes in the drawers 111 to 113 of the manually-handled money storage unit 100 have been mechanically managed and if the "EMPTY" button displayed in the management menu illustrated in FIG. 14A is pressed, then as illustrated in FIG. 13C, the denomination, the number, and the total amount of the banknotes having been stored in the respective drawers 111 to 113 are displayed in addition to the information about the mechanically-processed banknote storage units 231 to 236. If the "INVENTORY" button displayed in the management menu illustrated in FIG. 14A has been pressed, then as illustrated in FIG. 15D, the denomination, the number, and the total amount of the banknotes having been stored in the respective drawers 111 to 113 are displayed in addition to the information about the mechanically-processed banknote storage units 231 to 236. In FIGS. 15A and 15B, information about DRWR3 corresponding to the drawer 113 only is displayed, however, in a case where the money has been stored in the drawers 111, 112, information about the money stored in the respective drawers 111, 112 is displayed as information about DRWR1 and DRWR2.

Figure 16A:
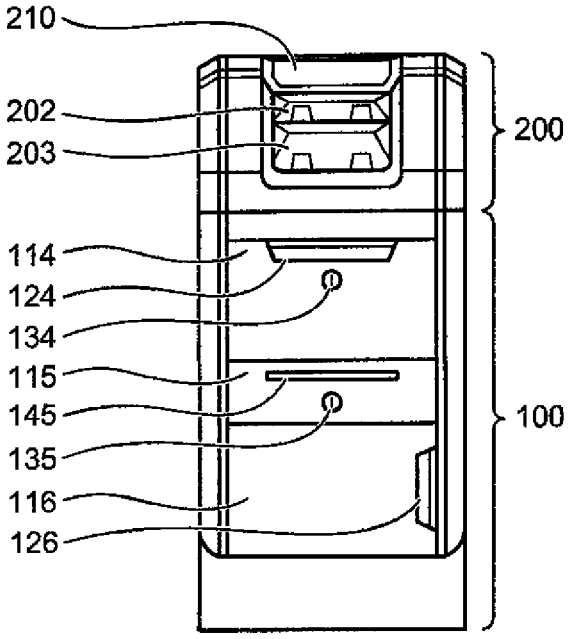
FIGS. 16A and 16B are views that illustrate an example of another configuration of the manually-handled money storage unit.
Figure 16B:
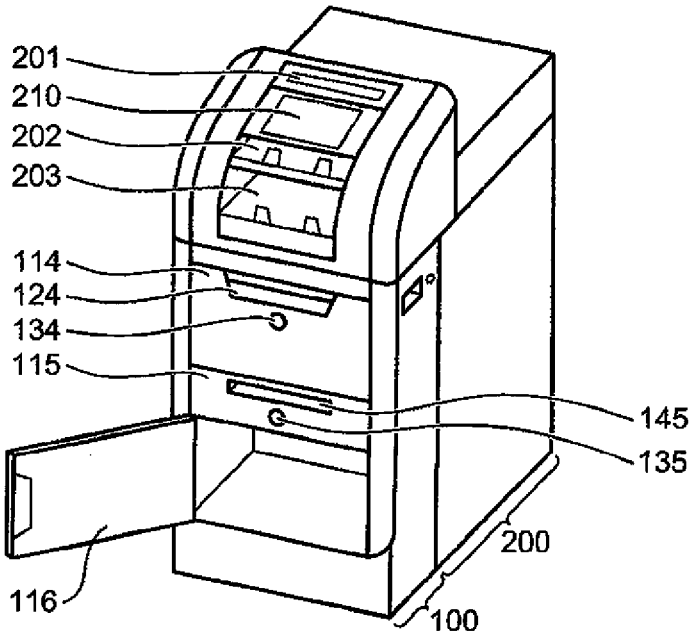

In FIGS. 5, 6A-6C, 7A-7C, 8A-8C, 9A-9C, and 10A-10C, the cases where the storage units of the manually-handled money storage unit 100 are the drawers 111 to 113 having the same configuration are illustrated; however, the present embodiment is not limited to them. FIGS. 16A and 16B are views illustrating an example in which the storage units of the manually-handled money storage unit 100 have mutually different configurations. FIG. 16A is a plan view illustrating the money handling apparatus 10 when viewed from the front side. FIG. 16B is a perspective view illustrating a state in which a door of a door opening/closing type storage unit 116 illustrated in FIG. 16A has been opened.

As illustrated in FIGS. 16A and 16B, the drawer 114, which includes a handle 124 and the locking mechanism 134, may be configured so as to have a vertical dimension (height) higher than those of the drawers 111 to 113 illustrated in FIGS. 5, 6A-6C, 7A-7B, 8A-8C, 9A-9C, and 10A-10C. Alternatively, conversely to this, the drawer 114 may be configured to have the vertical dimension (height) lower than those of the drawers 111 to 113 illustrated in FIGS. 5, 6A-6C, 7A-7C, 8A-8C, 9A-9C, and 10A-10C. In addition, as illustrated in FIGS. 16A and 16B, a drawer 115 may have a configuration including an inlet 145, which is constituted by a through hole, and a locking mechanism 135, instead of the door opening/closing handle. With the above-described configuration, documents related to the depositing and dispensing processes, checks, and the like can be deposited through the inlet 145 into the drawer 115 with the drawer 115 being closed. In addition, as illustrated in FIGS. 16A and 16B, the door opening/closing type storage unit 116 may be used instead of the drawer type storage unit. By pulling a handle 126, the door is opened and thus the teller's personal items, equipment of the bank branch 1, or the like can be stored in the storage unit 116.

Which of the drawer-type storage units and the opening/closing door type storage units are to be provided to the manually-handled money storage unit 100; which of the storage unit of a type in which money is stored by drawing the drawer to the front and the storage unit of a type in which money is stored by deposition through the inlet hole while the drawer is being closed is to be employed; the number of the storage units; the dimension (width, height, and depth) of the storage unit; whether to provide the storing unit with the drawer open/close state detection unit to detect the open/close state of the storage unit; whether to provide the storage unit with the drawer storage amount detection unit to detect the amount of money stored in the storage unit; whether to provide the drawer notification unit to notify the location of the storage unit; whether to mechanically manage the storage amount of the money in the manually-handled money storage unit 100; and whether to adjust the amount of the money stored in the manually-handled money storage unit 100 are appropriately determined in accordance with the modes of use.

In the example illustrated in FIG. 11, the storage amount of the money stored in all the drawers 111 to 113 is detected by the sensors to mechanically manage the storage amount; however, alternatively, the storage amount may be mechanically managed by using sensors provided only to some of the drawers. Drawers for storing objects that do not require mechanical management, i.e., a drawer for storing counterfeit banknotes and a drawer for storing checks, documents, and the like, may be excluded from the object of mechanical management and the other drawers only may be the objects of the mechanical management.

For the method of the mechanical management, alternatively to the method configured to manage the money storage amount by using the sensors for detecting the storage amount that are provided to the drawers 111 to 113, a method of the mechanical management by the mechanical processing unit 200 may be used. Also by managing the money to be stored in the drawers 111 to 113 by using the mechanical processing unit 200, the money to be stored in the drawers 111 to 113 can be mechanically managed without providing any sensors for detecting the open/close state and the storage amount of money in the drawers 111 to 113.

Specifically, when performing a depositing process in which the money is to be stored in the drawers 111 to 113, the money to be deposited is placed on the inlet 201 and the counting process is carried out for the money. After the denomination and the number (amount) of the money is recognized and counted, the money is discharged to the outlet 203, and the money is then stored in the drawers 111 to 113. The "COUNT" button corresponding to the normal counting process is included in the main menu shown in FIG. 13B. In addition to this button, a dedicated "COUNT CASH IN" button corresponding to a process for counting the money to be stored in the drawers 111 to 113 is provided in the main menu. When performing the depositing process using the drawers 111 to 113, the "COUNT CASH IN" button is pressed to perform the process for counting the money for the depositing process in the mechanical processing unit 200. The control unit 290 recognizes that the obtained recognition and counting results are information about the money to be stored in the drawers 111 to 113 and updates the data of the money that has been stored in the drawers 111 to 113 on the basis of the results of the recognition and the counting. Similarly, when performing a dispensing process by taking out the money from the drawers 111 to 113, the money that has been taken out from the drawers 111 to 113 is placed on the inlet 201 to perform the counting process for the money. After the denomination and the number (amount) of the money is recognized and counted, the money is discharged to the outlet 203, and the money is then used as the dispensed money for the dispensing process. In the main menu, a dedicated "COUNT CASH OUT" button corresponding to the counting process for the money to be taken out from the drawers 111 to 113 is provided. When performing a dispensing process using the drawers 111 to 113, the "COUNT CASH OUT" button is pressed to perform the process for counting the money for the dispensing process in the mechanical processing unit 200. The control unit 290 recognizes that the obtained recognition and counting results are information about the money taken out from the drawers 111 to 113 and updates the data of the money that has been stored in the drawers 111 to 113 on the basis of the results of the recognition and the counting. With this configuration, in the mechanical processing unit 200, the denomination and the storage amount of all the money that has been stored in the money handling apparatus 10 can be mechanically managed on the basis of the results of the recognition and the counting.

In FIG. 1, the network 23, to which the bank server 21 of the bank head office 2 and the bank terminal 22 of the bank branches 1 are connected, and the network 33, to which the monitoring server 31 of the money handling apparatus managing company 3 and the management terminal 12 of the bank branch 1 are connected, are separately provided; however, the present embodiment is not limited to this. For example, the present embodiment may have a configuration in which the bank server 21 of the bank head office 2 and the monitoring server 31 of the money handling apparatus managing company 3 may be communicably connected to each other via a network. The monitoring server 31 is capable of acquiring data of the depositing processes and the dispensing processes that have been performed at the bank branch 1 by using the money handling apparatus 10 from among data managed in the bank server 21, and is also capable of determining the storage amount of the money that is assumed to be stored in the money handling apparatus 10. In addition, the monitoring server 31 is capable of acquiring information about the storage amount of the money that has been actually stored in the money handling apparatus 10 via the management terminal 12, and is also capable of transmitting data to the management terminal 12. With this configuration, the monitoring server 31 or the management terminal 12 can perform a process for determining whether the data on the bank server 21 and the storage amount of the money that has been actually stored in the money handling apparatus 10 match each other. For example, if the data which is managed by the bank server 21 and the data of the money having been actually stored in the money handling apparatus 10 do not match each other, information about this non-matching status is notified from the management terminal 12 or the operation terminal 11 so that an operation for verifying the content of the processes that have been performed and an operation for verifying the money stored in the money handling apparatus 10 are performed, and thereby it is enabled to more strictly manage the money stored in the money handling apparatus 10.

Although the invention has been described with respect to specific embodiments for a complete and clear disclosure, the appended claims are not to be thus limited but are to be construed as embodying all modifications and alternative constructions that may 25 occur to one skilled in the art that fairly fall within the basic teaching of the claims.

What is claimed is:

1. A money handling apparatus comprising:

a mechanical processing unit configured to mechanically process money; and a manually-handled money storage unit configured to store money by manual handling, wherein the mechanical processing unit includes:

an inlet for receiving the money;

a recognition and counting unit configured to recognize and count the money that has been received in the inlet;

a mechanically-processed money storage unit configured to store the money;

an outlet to which the money fed from the mechanically-processed money storage unit is discharged; and a money transport unit configured to connect the inlet, the outlet, the recognition and counting unit, and the mechanically-processed money storage unit, wherein the manually-handled money storage unit is not connected to the money transport unit and has at least one drawer in which money to be manually managed is directly stored by hand and the money is directly taken out by hand, and the manually-handled money storage unit is slidably connected to the mechanical processing unit.

2. The money handling apparatus according to claim 1, wherein the manually-handled money storage unit includes a plurality of the drawers.

3. The money handling apparatus according to claim 1, wherein the manually-handled money storage unit is provided on a front surface side of the mechanical processing unit, the manually-handled money storage unit is laterally slid in a direction parallel to the front surface of the mechanical processing unit, and wherein the mechanically-processed money storage unit is fixed to the mechanical processing unit so that the mechanically-processed money storage unit is drawable while the manually-handled money storage unit is laterally slid.

4. The money handling apparatus according to claim 1, wherein the drawer is opened and closed in the front-back direction of the money handling apparatus, and the manually-handled money storage unit is slid in the left-right direction of the money handling apparatus.

5. The money handling apparatus according to claim 1, wherein the drawer is arranged below the inlet and the outlet that are arranged on a front side of the money handling apparatus.

6. The money handling apparatus according to claim 5, wherein the mechanical processing unit has a structure in which an upper portion and a lower portion are connected via the money transport unit, the upper portion includes the inlet, the recognition and counting unit, and the outlet, and the lower portion includes a plurality of the mechanically-processed money storage units.

7. The money handling apparatus according to claim 1, wherein a tray is installed in the drawer, and the tray is selected in accordance with an object to be stored in the drawer from among a plurality of types of trays each having a different structure.

8. The money handling apparatus according to claim 7, wherein the tray and a coin stacker for storing coins are installed in one drawer, and the tray has a structure that supports the coin stacker so that a position of the coin stacker is fixed.

9. The money handling apparatus according to claim 7, wherein the tray has a structure to partition a space inside of the drawer into a plurality of spaces for storing banknotes by denomination.

10. The money handling apparatus according to claim 7, wherein a plurality of openings is provided on an upper surface of the tray to store wrapped coin rolls by denomination, a wrapped coin roll being a predetermined number of coins wrapped together, and wherein the wrapped coin roll is inserted into the opening corresponding to the denomination and stands upright.

11. The money handling apparatus according to claim 10, wherein the opening has a shape of either one of a shape in which the respective wrapped coin roll is stored, a shape in which a plurality of the wrapped coin rolls is stored in a line, and a shape in which a plurality of the wrapped coin rolls is stored side by side in a plurality of lines.

12. A money handling apparatus comprising:

a mechanical processing unit configured to mechanically process money; and a manually-handled money storage unit configured to store money by manual handling, wherein the mechanical processing unit includes:

an inlet for receiving the money;

a recognition and counting unit configured to recognize and count the money that has been received in the inlet;

a mechanically-processed money storage unit configured to store the money;

an outlet to which the money fed from the mechanically-processed money storage unit is discharged;

a money transport unit configured to connect the inlet, the outlet, the recognition and counting unit, and the mechanically-processed money storage unit, and a control unit configured to manage the money in the mechanical processing unit, wherein the manually-handled money storage unit is not connected to the money transport unit and has a structure in which money to be manually managed is directly stored by hand and the money is directly taken out by hand, wherein the control unit is configured, if a total amount of money to be stored in the money handling apparatus has been inputted, to determine a storage amount of the money being stored in the manually-handled money storage unit on the basis of a storage amount of the money being stored in the mechanically-processed money storage unit.

13. The money handling apparatus according to claim 12, wherein the mechanical processing unit further comprises:

an operation unit configured to instruct performing of a depositing money counting process, in which money to be stored in the manually-processed money storage unit is placed in the inlet, the money is recognized and counted by the recognition and counting unit, and then the money is discharged to the outlet; and wherein the control unit is configured to update the storage amount of the money stored in the manually-processed money storage unit on the basis of results of the recognition and the counting by the recognition and counting unit of the depositing money counting process has been performed.

14. The money handling apparatus according to claim 12, wherein the mechanical processing unit further comprises:

an operation unit configured to instruct performing of a dispensing money counting process, in which money that has been taken out from the manually-processed money storage unit is placed in the inlet, the money is recognized and counted by the recognition and counting unit, and then the money is discharged to the outlet; and wherein the control unit is configured to update the storage amount of the money stored in the manually-processed money storage unit on the basis of results of the recognition and the counting by the recognition and counting unit of the dispensing money counting process has been performed.

15. A money handling apparatus comprising:

a mechanical processing unit configured to mechanically process money; and a manually-handled money storage unit configured to store money by manual handling, wherein the mechanical processing unit includes:

an inlet for receiving the money;

a recognition and counting unit configured to recognize and count the money that has been received in the inlet;

a mechanically-processed money storage unit configured to store the money;

an outlet to which the money fed from the mechanically-processed money storage unit is discharged;

a money transport unit configured to connect the inlet, the outlet, the recognition and counting unit, and the mechanically-processed money storage unit, and a control unit configured to manage the money in the mechanical processing unit, wherein the manually-handled money storage unit is not connected to the money transport unit and has a structure in which money to be manually managed is directly stored by hand and the money is directly taken out by hand, wherein the manually-handled money storage unit includes a storage amount detection unit configured to detect a storage amount of the money being stored inside thereof, and wherein the control unit is configured to manage the money stored in the mechanically-processed money storage unit on the basis of results of recognition and counting by the recognition and counting unit and to manage the money stored in the manually-handled money storage unit on the basis of results of detection by the storage amount detection unit.

16. The money handling apparatus according to claim 15, wherein when performing a depositing process for storing the money placed in the inlet into the mechanically-processed money storage unit, if the money includes any money of a denomination of which the amount stored in the manually-processed money storage unit is less than a previously set predetermined amount, the control unit is configured to discharge the money of the denomination to the outlet to be stored into the manually-processed money storage unit, and store other money in the mechanically-processed money storage unit in order to store the money of the denomination into the manually-processed money storage unit.

17. The money handling apparatus according to claim 15, wherein when performing a dispensing process for discharging designated money from the mechanically-processed money storage unit to the outlet, if the designated money includes any money of a denomination of which the amount stored in the manually-processed money storage unit is more than a previously set predetermined amount, the control unit is configured to discharge money except the money of the denomination from the mechanically-processed money storage unit to the outlet so that the money of the denomination is taken out manually from the manually-processed money storage unit.

18. The money handling apparatus according to claim 15, wherein the control unit is configured to notify of a position of the drawer into which money is to be stored or from which money is to be taken out.

* * * * *